US005790420A

United States Patent [19]

Lang

[11] Patent Number: 5,790,420

[45] **Date of Patent: *Aug. 4, 1998**

[54] METHODS AND SYSTEMS FOR IMPROVING THERMAL EFFICIENCY, DETERMINING EFFLUENT FLOWS AND FOR DETERMINING FUEL MASS FLOW RATES OF A FOSSIL FUEL FIRED SYSTEM

[76] Inventor: Fred D. Lang, 12 San Marino Dr., San Rafael, Calif. 94901

[ * ] Notice: The term of this patent shall not extend beyond the expiration date of Pat. No. 5,367,470.

[21] Appl. No.: 344,541

[22] Filed: Nov. 21, 1994

Related U.S. Application Data

[63] Continuation-in-part of Ser. No. 835,719, Feb. 12, 1992, Pat. No. 5,367,470, which is a continuation-in-part of Ser. No. 450,686, Dec. 14, 1989, abandoned.

[51] Int. Cl.[6] ..... G06F 15/46

[52] U.S. Cl. ..... 364/494; 364/491; 73/23.31

[58] Field of Search ..... 364/494, 483, 364/498, 148, 510; 60/39.03, 39.05, 39.5, 39.01, 39.182, 39.461, 39.02, 670; 429/12, 19, 26; 73/23.31, 25.01; 423/212, 235, 237

[56] References Cited

U.S. PATENT DOCUMENTS

| | | | |
|---|---|---|---|
| 3,900,554 | 8/1975 | Lyon | 423/235 |
| 3,988,926 | 11/1976 | Haas | 73/15.4 |
| 4,220,632 | 9/1980 | Pence et al. | 423/239 |
| 4,801,209 | 1/1989 | Wadlow | 364/498 |
| 4,861,263 | 8/1989 | Schirmer | 431/158 |
| 5,055,030 | 10/1991 | Schirmer | 431/10 |
| 5,199,263 | 4/1993 | Green et al. | 423/242.2 |
| 5,327,356 | 7/1994 | Lang et al. | 364/498 |
| 5,367,470 | 11/1994 | Lang | 364/498 |
| 5,432,710 | 7/1995 | Ishimaru et al. | 364/493 |

*Primary Examiner*—James P. Trammell
*Assistant Examiner*—Bryan Bui

[57] ABSTRACT

Methods and systems are disclosed for: (1) determining and improving the thermal efficiency of a fossil fuel power plant, such as a combustion turbine system, by indirect assessment of input fossil fuel flow rate, and direct observation of various gaseous effluents; (2) determining total effluent gas flow rates; (3) determining input fuel mass flow rates; and (4) determining flow rates of various constituent gases making up the effluent gas.

40 Claims, 5 Drawing Sheets

METHODS AND SYSTEMS FOR IMPROVING THERMAL EFFICIENCY, DETERMINING EFFLUENT FLOWS AND FOR DETERMINING FUEL MASS FLOW RATES OF A FOSSIL FUEL FIRED SYSTEM

CROSS REFERENCE

This application is a continuation-in-part of application Ser. No. 07/835,719, filed Feb. 12, 1992, U.S. Pat. No. 5,367,470 which was a continuation-in-part of application Ser. No. 07/450,686, filed Dec. 14, 1989, now abandoned.

This application is related to U.S. Pat. No. 5,327,356, entitled "Emission Spectral Radiometer/Fuel Flow Instrument", which patent is incorporated herein by reference in its entirety.

BACKGROUND

The present invention relates to a method and system for determining and improving the thermal efficiency of a system producing a useful energy flow and/or power, such as of a fossil fuel plant. In particular, the present invention relates to a method and system for determining and improving the thermal efficiency of a combustion turbine system.

The present invention also relates to methods and systems for determining effluent gas flow rates, input fuel mass flow rates, and for determining flow rates of constituent gases, including gaseous pollutants, making up the effluent gas.

Due to increasing fuel costs, the need to capture heat from an industrial process, and environmental regulations, maintaining and increasing the thermal efficiency of a power plant is an important objective of power plant design, maintenance and operation. Thermal efficiency can be defined as useful power and energy flow output over energy flow input.

Combustion of a fossil fuel can result in the generation of large effluent gas volumes. The effluent gas, also referred to as flue gas or stack emissions, is a mixture of various combustion gases, including superheated water, and usually also includes entrained particulate matter. For environmental, regulatory, and process control reasons, it can be important to accurately determine effluent gas characteristics, such as effluent gas flow rates. Additionally, and for the same reasons, it can be important to determine the mass flow rates of a fossil fuel into the power plant.

A combustion turbine system ("CT") can provide a highly reliable and low capital cost method of producing power. An example of a combustion turbine system is a jet engine fired with kerosene or natural gas. A combustion turbine power plant system includes, at least, a compressor, a combustor and a turbine. The compressor rotates drawing in and pressurizing ambient air. The temperature of the air increase due to its compression. The pressurized, hot air is forced into the combustor. A fuel is burned in the compressor with the compressed air, producing high energy combustion gases. The fuel combusted can be a natural gas, oil, synthetic gas, coal or other combustible material.

The energy of the combustion gases can be converted into power by expansion in the turbine. A portion of the mechanical power produced by expansion of the gas in the turbine is used to drive the compressor. The combustion turbine's useful power output, comprising the remaining thermal power converted into a kinetic energy flow, can be used to drive an external mechanical load through a shaft coupling.

A combustion turbine system can have a single, two or three shaft design. In the single shaft design, one continuous shaft is present and all turbine stages operate at the same speed. In a two shaft combustion turbine, the high pressure turbine can drive the compressor and the low pressure (i.e. power) turbine can be used for useful power output. With a three shaft combustion turbine, a high pressure turbine can drive a high pressure compressor, a low pressure turbine can drive a low pressure compressor, and the power turbine can produce useful power.

A combustion turbine system can convert about 20% or more of the thermal energy flow of the input fuel into a shaft output. Most of the remainder is released as effluent gas or exhaust heat. Thus, one way to improve the thermal efficiency of a combustion turbine system is to recover some of the lost heat. One way to accomplish this is to add a regenerator to the system. A regenerator is a heat exchanger that transfers exhaust heat to the compressor discharge air before it enters the combustor. Thermal efficiency can also be improved by cooling the inlet air to the compressor.

An alternate way to recapture some of the exhaust heat is to integrate a combustion turbine system with a steam producing system to thereby increase power production efficiency. In such a combined cycle system exhaust heat from the combustion turbine serves as a heat source for a steam turbine cycle. Such a combined cycle can increase system thermal efficiency to about 45% or higher.

A combined cycle system can include a combustion turbine system, a heat recovery steam generator unit and a steam turbine system, the combination of which can be referred to as a "CT/HRSG" system. The heat recovery steam generator ("HRSG") unit itself can alternately and equivalently be referred to as a turbine exhaust gas boiler, a waste heat recovery boiler, or simply as a recovery boiler.

An CT/HRSG system can include various items of ancillary equipment such as a condenser, feedwater heat exchangers, pumps and auxiliary systems. A supplemental firing system can also be installed upstream of the heat recovery steam generator unit. Furthermore, a CT/HRSG system can also include a mechanism for injection of water, steam or a water/steam combination into the combustion turbine to control pollutant production, such as $NO_X$, or to assist in optimizing operations of the CT/HRSG system.

The term "CT/HRSG" can be used to designate either or both a simple CT system or a more complex combined CT and HRSG system.

As with any fossil fuel plant producing power and/or a useful energy flow, it can be important to closely monitor the thermal efficiency of a CT/HRSG system. An improvement to plant thermal efficiency first requires that the actual or operating thermal efficiency be determined. The thermal efficiency of a plant producing power and/or a useful energy flow can be determined by comparing this output to the total input energy flow. The useful output for a CT or a HRSG system can include an energy flow and/or electrical power and/or mechanical power production.

In addition to assisting a determination of thermal efficiency, determinations of input fossil fuel energy flow and stack emissions can have independent importance. Thus, the determination of input fuel energy flow is important to compare with directly measured fuel flow, and can be used to validate the thermodynamic understanding of the entire power generating system. Determinations of stack emissions can have importance for regulatory compliance relating to environmental protection.

Thermal efficiency can theoretically be determined by measuring the total useful output of a thermal system in comparison to the fuel energy flow input. Unfortunately, it is very difficult if not impossible to accurately determine thermal efficiency of a coal-fired power plant in such a manner because of highly variable fuel input volume, content, and quality. Thus, determining thermal efficiency by directly sampling input coal energy flow is not practical.

Attempts to directly measure input fossil fuel energy require information regarding both the heating value of the input fossil fuel, and the mass flow rate of the fossil fuel into the system. Often, a combustion turbine fossil fuel supply is not well characterized as to fuel chemical composition, and the heating value of the fossil fuel is therefore not known and cannot be readily determined. This can occur in particular when a mix of fuels is employed or the fuel source changes.

Additionally, direct measurement of an input fossil fuel flow rate can be difficult and impractical, as for example at lower fuel input loads where fuel flow measurement devices are not properly calibrated. Furthermore, variation in a fossil fuel's heating value often occur due to variations in the make-up of the fuel supplied and such a variation makes heating value calculation by fuel sampling imprecise.

Existing methods for measuring natural gas, oil, input fuel flow rates typically result in a minimum variance of the measured flow rate of about ±1.6% relative to the actual. For comparison, a typical variance of measured the flow rate for compressed water can be accurate within about ±0.25% relative to the actual. As a practical matter, if industrial accuracies of natural gas or oil flow measurement are acceptable, the ability to indirectly determine such flows can provide an excellent overcheck of basic thermodynamic understanding of the system being monitored. Additionally, such an overcheck function can validate the accuracy of calculated emission flow rates.

The measurement of a fossil fuel input flow rate is usually accomplished by measurement of a mechanical effect of the fuel flow, such as a pressure drop across a nozzle or orifice plate, a fluid density, a unit weighing of fuel handling conveyor belts (commonly used for coal fuel), a speed of sound, a nuclear resonance, or a change in bulk storage levels effect upon a sensor. A fuel flow sensor must be carefully and repeatedly calibrated to achieve an acceptably accurate fuel flow measurement. Nevertheless, a daily calibration drift in excess of ±1.0% is common, in addition to accuracy variances inherent to the fuel flow measurement device used.

Thus, direct fuel flow measurement entails significant inaccuracy and imprecision in the range of ±2% to ±5% for a gas or oil fossil fuel supplied CT/HRSG system. Such an inaccuracy range in the measured fuel flow rate prevents efficient monitoring of the thermal efficiency performance of a power plant. Although it is technically possible to monitor gas or oil fuel flow rates to an accuracy of about a ±0.25% variance of measured as compared to actual, by using laboratory grade equipment and calibrated methods, such a setup is not practical or feasible for continuous or routine monitoring of fossil fuel flow rates in the industrial setting of a power plant.

A technique for measuring power plant thermal efficiency is discussed in the technical paper E. Levy, N. Sarunac, H. G. Grim, R. Leyse and J. Lamont, (Electric Power Research Institute, Morgantown power plant) *Output/Loss: A New Method for Measuring Unit Heat Rate,* Am. Society of Mech. Engrs., 87-JPGC-Pwr-39. This technique is called an "Output/Loss" Method and is intended for a conventional fossil-fired boiler. This method produces a boiler efficiency value independent of the actual fuel flow. If the fuel heating value and the useful energy flow and/or power delivered from the system are known, then a power plant thermal efficiency can be determined. The technique relies on measuring emission gas flow directly, from which a determination of the majority of the thermal losses associated with combustion, called "stack losses" can be determined. However, the technique is not practical for most conventional power plants or CT/HRSG Systems for at least the following reasons: 1) it does not address measurement of flue gas concentrations (thus it accomplishes no updating of water/steam in-flows or heating value, as is accomplished by the present); 2) the errors in gas flow measurements in irregular ducts not designed for accurate flow measurements, which is the case at most industrial facilities, can easily exceed ±20% resulting in over ±2% error in system efficiency; 3) the technique of direct flue gas flow measurements does not routinely meet regulatory requirements of a maximum ±15% variance; and 4) the technique does not determine emission rates ($lb_{pollutant}$/million-$Btu_{fuel}$), since emission concentrations are not known through use of the technique.

Thus, a need exists for a method and system for accurately determining and improving the thermal efficiency of a power plant, such as a CT/HRSG system, without the necessity of making any direct measurement of an input fossil fuel flow rate.

In particular, such a method is needed where the fuel is a bulk fuel such as coal, because direct measurement of such a fuel's input flow rate is not practical in a large power plant.

A need also exists for a method and system for determining total effluent gas flow rates, input fuel mass flow rates, and for determining flow rates of constituent gases making up the effluent gas.

SUMMARY

The present invention meets these needs and provides a method and system for accurately determining and improving the thermal efficiency of an energy producing system, such as a combustion turbine system, without the need for any direct measurement of input fossil fuel energy flow rate. Methods and systems within the scope of the present invention can also determine total combustion effluent output flow rates, input fuel mass flow rates, and the flow rates of various constituent gases, including gaseous pollutants, making up the effluent gas.

The accuracy of the determinations made by the disclosed methods and systems can exceed those possible with previously known methods and systems. The disclosed methods make use of various items of input information, such as reference system operating and emission data, for comparison to determined or calculated results.

The disclosed methods can be used where the input fuel is either a solid, liquid or gaseous fuel. Thus, for a solid or bulk fuel the disclosed method provide a simple and effective method for indirectly determining input fuel energy flow, and hence system thermal efficiency. For a gaseous or liquid fuel, the disclosed method can, for example, provide a confirmation of and a better understanding of power plant thermodynamic.

The method of the present invention for improving the thermal efficiency of a system, such as a CT/HRSG system, is carried out by monitoring the operation of the system and making calculations based upon data obtained from an analysis of input fuel composition and from observation of combustion effluents.

Preferably, the disclosed method can detect a fossil fuel power plant thermal efficiency change as small as about 0.2% Δη. More preferably, the disclosed method can detect a fossil fuel power plant thermal efficiency change as small as about 0.01% Δη. A thermal efficiency change as small as about 0.2% Δη requires thermal precision and stability of the instrumentation providing the required input and/or reference data. A thermal efficiency change as small as about 0.01% Δη requires extremely precise and stable measuring instrumentation and operating conditions whilst obtaining the requisite input and/or reference data. Subsequent to detection of a thermal efficiency change, use of ancillary control logic and attendant mechanisms (i.e. valve control means, fuel conveyor controller, shaft speed, emission modification equipment) linked to the detection system or through prompted operating personnel, corrective action can be taken. Notably, a 0.01% Δη increase for a large power generating plant can translate to about a $12,000 increase in plant gross profit.

A method for improving a thermal efficiency and/or a system efficiency of a fossil fuel fired system (such as a combustion turbine system) can comprise the steps of: analyzing a sample of a fossil fuel supplied to a combustor of the system to determine the composition of the fossil fuel; measuring a temperature of a gas effluent from the combustor, wherein the effluent gas comprises a mixture of constituent gases; measuring a concentration of a gaseous constituent of the gas effluent from the combustor; determining a thermal efficiency of the system; comparing the thermal efficiency of the system to a reference thermal efficiency; and adjusting an operation of the system to improve a thermal efficiency and/or a system efficiency of the system.

A combustion turbine system thermal efficiency can be determined by a submethod comprising the steps of: determining a combustion efficiency; determining an absorption efficiency; and then combining the combustion efficiency and the absorption efficiency, to thereby determine a combustion turbine system system efficiency. A combustion turbine system thermal efficiency can be determined independently of a fuel flow rate of a fossil fuel supplied to the combustor. Furthermore, the method can include the step of analyzing a sample of a fossil fuel for its dry base chemical composition.

In the disclosed method, a constituent gas can be carbon dioxide, and the temperature and concentration of the carbon dioxide in the gas effluent from the combustor can be measured. Preferably, the concentration of the carbon dioxide gas effluent from the combustor is measured to an accuracy of at least about ±1% Δ molar. More preferably, the concentration of the carbon dioxide gas effluent from the combustor is measured to an accuracy of at least about ±0.5% Δ molar.

Another constituent gas of the effluent gas (i.e. the effluent gas is a mixture of various gases) can be superheated water, and the temperature and concentration of superheated water in the gas effluent from the combustor can be measured. Preferably, the concentration of the superheated water effluent from the combustor is measured to an accuracy of at least about ±1% Δ molar. More preferably, the concentration of the superheated water effluent from the combustor can be measured to an accuracy of at least about ±0.5% Δ molar.

A further constituent gas can be oxygen and the concentration of oxygen in the gas effluent from the combustor can be measured. Preferably, the concentration of the oxygen gas effluent from the combustor is measured with an accuracy at least comparable to zirconium oxide detection.

A more detailed embodiment of the disclosed method for improving a thermal efficiency and/or a system efficiency of a combustion turbine system (or of a combined combustion turbine system and heat recovery steam-generator system), can have the steps of: analyzing a sample of a fossil fuel supplied to a combustor of a combustion turbine system to determine the dry base chemical composition of the fossil fuel; measuring at a gas exit boundary of the combustion turbine system in an exhaust from the combustion process;

a temperature of a gas exiting the combustion turbine, a concentration of gaseous carbon dioxide to an accuracy of at least about ±0.5% Δ molar, a concentration of a superheated water effluent to an accuracy of at least ±1% Δ molar, and a concentration of a gaseous oxygen effluent with an accuracy at least comparable to zirconium oxide detection;

determining, independently of a fuel flow rate of a fossil fuel into the combustor, a combustion efficiency; determining an absorption efficiency; combining the combustion efficiency and the absorption efficiency to determine a combustion turbine system system efficiency; comparing the combustion turbine system system efficiency to a reference combustion turbine system efficiency; and adjusting an operation of the combustion turbine system to improve a thermal efficiency and/or a system efficiency of the combustion turbine system.

A further method within the scope of the present invention for improving a thermal efficiency of a combined heat recovery-steam generator and combustion turbine system can have the steps of: analyzing a sample of a fossil fuel supplied to a combustor of a combustion turbine system to determine the composition of the fossil fuel; measuring a temperature and concentration of a combustion gas effluent from the combustor; measuring a net energy deposition and power developed from the combustion gas; determining independently of a fuel flow rate of a fossil fuel into the combustor, a combustion efficiency based upon a stoichiometric balance of a combustion equation and an absorption efficiency based upon a measurement of a non-stack heat loss; combining the combustion efficiency and the absorption efficiency to determine a combined heat recovery-steam generator and combustion turbine system system efficiency; comparing the combined heat recovery-steam generator and combustion turbine system efficiency to a reference combined heat recovery-steam generator and combustion turbine system efficiency; and adjusting an operation of the combined heat recovery-steam generator and combustion turbine system to improve a thermal efficiency of the combined heat recovery-steam generator and combustion turbine system. This method can also include the steps of repetitiously adjusting an assumed water concentration in the fuel until consistency is obtained between the measured $CO_2$ and $H_2O$ effluents and computed $CO_2$ and $H_2O$ effluents determined by stoichiometrics based on the chemical composition of the fuel, thereby establishing the validity of the calculated combustion turbine efficiency and/or total system efficiency. Notably, the measured carbon dioxide and water effluents can be measured using an emissions spectral radiometer instrument. This last method can also include determining whether degradations of operation are occurring in the recovery boiler or in the combustion turbine, and whether stack losses are increasing, by detecting decreases in combustion efficiency which is determined in an iterative manner. Additionally, the method can also have the step of determining whether degradations of operation are occurring due to increased radiation and convection losses, heat content remaining in the heat exchanger water/steam leaks, heat exchanger loss of effectiveness, and increases in other non-stack losses by observing decreases in iterative absorption efficiency calculations.

Another method within the scope of the present invention for determining and improving thermal efficiency and/or system efficiency of a fossil-fired combustion turbine system comprising a combustion turbine in which a fossil fuel is supplied at a flow rate to produce shaft power, the combustion of the fuel producing an effluent combustion gas in an exhaust, the effluent combustion gas from the combustion turbine being capable of heating a working fluid, and a turbine cycle in which the working fluid does work, can comprise the following steps: analyzing the fuel for its dry base chemical composition; measuring in the exhaust combustion gas from the combustion process at the gas exit boundary of the power plant system the temperature, concentrations of $CO_2$ and $H_2O$ effluents to at least an accuracy of ±1% a molar, and concentrations of $O_2$ with an accuracy at least comparable to zirconium oxide detection; measuring the shaft power produced; determining, independently of the fuel mass flow rate, both a combustion efficiency as based on a stoichiometric balance of a combustion equation and an absorption efficiency based on determination of non-stack losses; combining combustion efficiency and absorption efficiency to obtain a combustion turbine system system efficiency; repetitiously adjusting assumed water concentration in the fuel until consistency is obtained between the measured $CO_2$ and $H_2O$ effluents and those determined by stoichiometries based on the chemical concentration of the fuel for establishing validity for a calculated fuel mass flow rate and boiler efficiency; determining whether degradations from predetermined parameters are occurring in the fuel-air mixing equipment, the differential system fuel flows, the heat content of the fuel, and whether stack losses are increasing by detecting decreases in iterative combustion efficiency calculations; determining whether degradations from predetermined parameters are occurring due to increased radiation and convection losses, heat content remaining in the coal rejects, heat exchanger water/steam leaks, heat exchanger loss of effectiveness, and increases in other non-stack losses by detecting decreases in iterative absorption efficiency calculations; and adjusting operation of the system to improve its thermal efficiency and/or its system efficiency.

A method for determining fuel flow rate and pollutant flow rates of a fossil-fired useful system (such as a combustion turbine system) by monitoring the operation of the steam generator system and making calculations which are derived from data obtained from the analysis of the chemical composition of the dry component of the fuel, the concentrations of the common pollutants produced from combustion, and the concentrations of $CO_2$ and superheated water produced from combustion and the fuel. This method can have the steps of: analyzing the fuel for its dry base chemical composition; measuring at a gas exit boundary of the steam generator system in the exhaust of the combustion process the temperature, concentrations of $CO_2$ and $H_2O$ effluents to an accuracy of at least ±1% Δ molar, and concentrations of $O_2$ with an accuracy at least comparable to zirconium oxide detection; measuring the net energy deposition to a working fluid being heated by the combustion process; calculating, independently of the fuel flow rate, a combustion efficiency based on the stoichiometric balance of a combustion equation and an absorption efficiency based on determination of non-stack losses; combining the combustion efficiency and the absorption efficiency to obtain a combustion turbine system system efficiency; and determining the fuel flow rate from the combustion turbine system efficiency. The method just disclosed can also include the step of repetitiously changing the assumed value of water concentration in the fuel until consistency is obtained between the measured $CO_2$ and $H_2O$ effluents and computed $CO_2$ and $H_2O$ effluents determined by stoichiometries based on the chemical composition of the fuel, thereby establishing validity for the calculated fuel mass flow rate. This last method can also include action taken to adjust operation of the steam generator system to minimize pollutant concentrations effluent from the steam generator system by lowering the fuel firing rate, by mixing fuels having different sulfur contents for $SO_2$ and $SO_3$ control, by lowering the combustion flame temperature for $NO_X$ control and other such actions necessary to reduce pollutant concentrations.

Additionally, the action taken to adjust operation of the steam generator system to minimize pollutant effluent flow rates from the steam generator system by lowering the fuel firing rate, can be by mixing fuels having different sulfur contents for $SO_2$ and $SO_3$ control, by lowering the combustion flame temperature for $NO_X$ control, by mixing fuels having different nitrogen contents for $NO_X$ control, and other such actions necessary to reduce pollutant flow rates.

The disclosed method for determining fuel flow rate and pollutant flow rates can include the steps of repetitiously changing an assumed value of water concentration in the fuel until consistency is obtained between the measured $CO_2$ and $H_2O$ effluents and the computed $CO_2$ and $H_2O$ effluents determined by stoichiometries based on the chemical composition of the fuel, thereby establishing validity for the calculated pollutant flow rates.

The present invention also includes within its scope a method for determining fuel flow, total effluent flow rate, and individual pollutant flow rates, and improving thermal and/or system efficiency of a fossil-fired steam generator power plant system comprising a steam generator system in which a fossil fuel is supplied at a flow rate to be combusted to produce shaft power and/or to heat a working fluid, the combustion of the fuel producing effluents in an exhaust, and a turbine cycle in which the working fluid does work, the method comprising the steps of: analyzing the fuel for its dry base chemical composition; measuring at a gas exit boundary of the power plant system, in the exhaust, the temperature, the concentrations of $CO_2$ and $H_2O$ effluents to a predetermined accuracy, and $O_2$ with an accuracy at least comparable to zirconium oxide detection; measuring shaft power produced and/or the net energy deposition to the working fluid being heated by the combustion process; determining, independently of the fuel flow rate, a combustion efficiency based on a stoichiometric balance of a combustion equation and an absorption efficiency based on determination of non-stack losses; combining the combustion efficiency and the absorption efficiency to obtain a system efficiency; determining an auxiliary turbine efficiency; determining a shaft efficiency; combining the absorption efficiency, the turbine cycle efficiency, and the shaft efficiency to obtain the total system efficiency; determining in response to obtaining the absorption efficiency and the system efficiency if either is degraded from predetermined parameters; and adjusting operation of the power plant system to improve its absorption efficiency and/or its total system efficiency. This method can also include the steps of: determining the fuel flow rate from the absorption efficiency; measuring the concentration of the common pollutants in the exhaust of the combustion process with an accuracy comparable to standard industrial practise; determining the pollutant flow rates from the fuel mass flow rate, knowledge of the concentrations of the common pollutants, and by determining the total effluent flow rate through stoichiometics; and of repetitiously adjusting an assumed water concentration in the fuel until consistency is obtained between the measured $CO_2$ and $H_2O$ effluents and the $CO_2$ and $H_2O$ effluents determined by stoichiometrics based on the chemical composition of the fuel, thereby establishing the validity of the calculated boiler efficiency and/or total system efficiency.

A method for determining an input fossil fuel mass flow rate into a combustor of a combustion turbine system can have the steps of determining a chemical composition of a sample of the input fuel and determining temperature and concentration of a plurality of gaseous constituents of a combustion gas produced by combustion of the fuel in the combustor.

A method for determining a flow rate of an effluent gas produced by combustion of a fossil fuel in a thermal system (such as a conventional boiler system, a combustion turbine system, and a combined combustion turbine system and heat recovery-steam generator system) can include the steps of: measuring a temperature of an effluent gas, wherein the effluent gas comprises a mixture of constituent gases; measuring a pressure of the effluent gas; determining a concentration of a constituent gas in the effluent gas; determining a density of the effluent gas; determining an average molecular weight of the constituent gases; determining a molecular weight of the fuel combusted; determining a molar fraction of the as-fired fuel required to generate a reference unity moles of the effluent gas; and determining an as-fired mass flow rate of the fuel combusted, thereby determining effluent gas flow rate.

A method for determining and improving thermal and/or system efficiency according to the present invention can comprise the steps of: first analyzing the fuel for its dry base chemical composition; measuring the temperature of the effluents; the concentrations of carbon dioxide gas ($CO_2$) and superheated water ($H_2O$) present in the effluent gas to an accuracy of at least about ±1% or 0.5% Δ molar; the concentrations of common gaseous pollutants in the effluent gas to accuracies acceptable to regulatory authorities, and measurement of the concentration of $O_2$ present in the effluent gas with an accuracy at least comparable to zirconium oxide detection—all these gas concentrations are measured at the combustion gas exit boundary of the thermal system; measuring the gross shaft electrical or mechanical power and net energy deposition to the fluid being heated by the combustion process; calculating both the combustion efficiency based on the stoichiometric balance of the combustion equation and the absorption efficiency based on determination of non-stack losses independent of the fuel flow rate; arithmetically combining combustion efficiency and absorption efficiency to obtain a calculated system efficiency which is perfectly consistent with such efficiencies such as those suggested by the ASME Power Test Codes ("PTC") (in particular reference PTC 4.1, 4.4 and 22); back-calculating fuel flow rate from the PTC definition of thermal efficiency; calculating total effluent flow rate and emission rates for all pollutants based on fuel flow and resolved stoichiometrics; and finally adjusting operation of the system to improve its thermal efficiency, and/or its system efficiency, and/or to minimize the pollutant emissions.

A method within the scope of the present invention for determining fuel and effluent flows and thermal efficiency can also include the steps of repetitiously adjusting for assumed water/steam concentration found either in the as-fired fuel and/or added by injection into the combustion turbine and/or added via in-leakage at the HRSG, until stoichiometric consistency is obtained between the measured $CO_2$ and $H_2O$ effluents and those determined from stoichiometrics based on the as-fired fuel and water in-flows. Although the composition of as-fired (wet) fuel and water/steam in-flows is assumed in an iterative manner, any hydrocarbon fuel will produce unique relative concentrations of $CO_2$, $H_2O$ and $O_2$ as effluents.

The present invention also include a system for improving a thermal and/or system efficiency of a combustion turbine system. Such a system can comprise: apparatus for analyzing a sample of a fossil fuel supplied to a combustor of a combustion turbine system to determine the composition of the fossil fuel; apparatus for measuring a temperature of a gas effluent from the combustor, wherein the effluent gas is a mixture of constituent gases; apparatus for measuring a concentration of a constituent gas; apparatus for determining a combustion turbine system efficiency; apparatus for comparing the combustion system efficiency to a reference combustion system efficiency; and apparatus for adjusting an operation of the combustion turbine system to improve a thermal and/or system efficiency of the combustion turbine system.

The apparatus for analyzing a sample of a fossil fuel can be a gas chromatograph for gaseous fuels, and a mass spectrometer for a solid fuel such as coal or for a liquid fuel such as oil. The apparatus for measuring a temperature of a gas effluent from the combustor can be a thermocouple. The apparatus for measuring a concentration of a constituent gas can be an emissions spectral radiometer. The apparatus for determining a combustion turbine system efficiency, for comparing the combustion system efficiency to a reference combustion system efficiency, and for adjusting an operation of the combustion turbine system to improve a thermal efficiency and/or a system efficiency of the combustion turbine system can include a programmed computer.

An apparatus used for practicing the present invention includes a measurement device which can determine the effluent concentrations of $H_2O$ and $CO_2$ to high accuracy, as well as capability to measure effluent $O_2$ concentration. A suitable measurement device can be a commercially available Fourier transform infrared (FTIR) instrument, or any other instrument which can achieve high accuracy and maintain continuous operation, such as a spectral radiometer (termed an ESR/FF instrument) disclosed in U.S. Pat. No. 5,327,356, which patent is incorporated herein by reference in its entirety.

To summarize, methods and systems within the scope of the present disclosed invention can be used to determine and/or to improve: thermal efficiency, absorption efficiency and/or system efficiency; fuel flow; total emission or effluent flow; and flow rates of constituent gases comprising the effluent flow in various types of systems capable of producing a useful energy flow and/or power, such as a fossil fuel, steam-generating power plant system. Wide applicability of the disclosed methods can be achieved because of the commonality of thermodynamic principles and numerous elements, such as, for example: a carbonaceous fuel, which when combusted, releases heat and generates combustion gases; a furnace or combustor; a convection pass; heat exchangers, comprising water or steam-filled tube bundles; and one or more turbines.

DRAWINGS

These and other features, aspects and advantages of the present invention can become better understood from the following description, claims and the accompanying drawings where:

DESCRIPTION

Figure 1A:
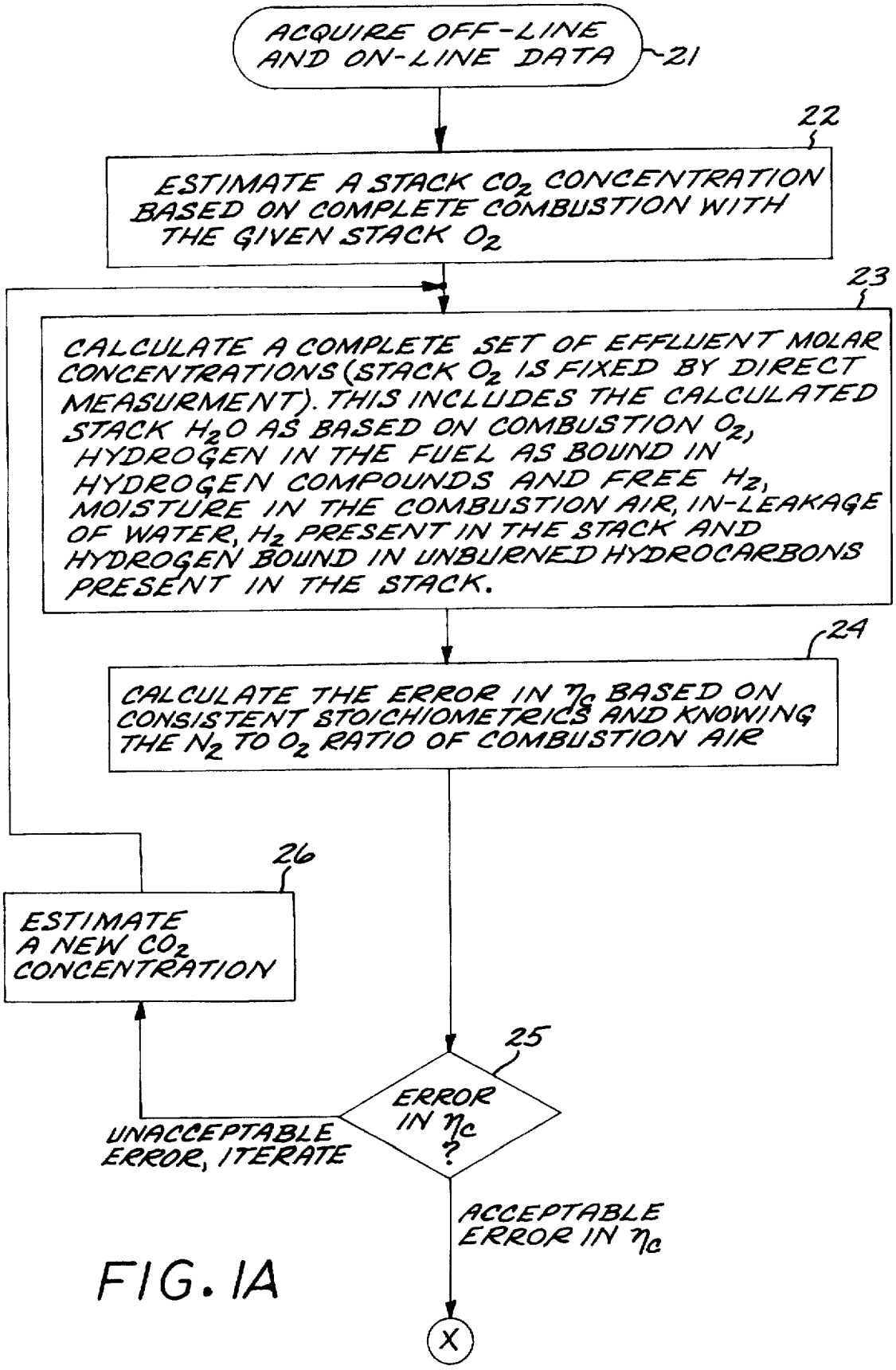
FIGS. 1A and 1B are block diagrams illustrating the steps of a preferred embodiment of the disclosed methods for determining thermal efficiency, fuel flow rate, and effluent flow rates for a system capable of producing a useful energy flow and/or power.

The present invention is based upon the discovery that the thermal efficiency of a fossil fuel power plant can be improved by determining an input fuel flow, measuring certain chemical properties of the fuel, measuring certain properties of the effluent combustion gases, and application of thermodynamic principles. The input fuel flow is determined indirectly without any actual fuel flow rate measurement.

Thus, the present invention encompasses a unique method and system for determining an input fossil fuel mass flow rate into a system, such as a CT/HRSG System, through application of thermodynamic principles, and without any direct measurement of input fossil fuel flow. This method relies primarily on measurements of the fuel's heating value, and measurement of concentrations of certain gaseous constituents of the combustion gas effluent from a CT/HRSG system. Other parameters which can be measured as input data for the disclose method can include: generator gross load and house load (in MWe); feedwater flow, and its estimated variance; all data necessary to determine the energy flow deposition to the working fluid and estimates of the variance on associated flows; ambient pressure; forced draft fan, air preheater and boiler pump input break powers for gross unit heat rate effect; stack temperature downstream of the air heater; ratio of carbon dioxide, oxygen, or of carbon monoxide across the air heater; and non stack losses and molar ratio of unburned carbon in the ash.

The disclosed method and system is suitable for continuous monitoring of a fossil fuel power plant for the purpose of obtaining and maintaining an improved thermal efficiency. The data obtained can be input to a computer program for resolution of mass and energy balances associated with a power plant system.

The method is based upon measurement of: gaseous effluent concentrations exiting a furnace chamber or combustion reactor as combustion gases (the "primary fluid"); direct power production; and a total energy deposition from the combustion gases to, in a CT/HRSG system, a secondary fluid circulated in a recovery boiler.

Thermal Efficiency

An important objective of the present invention is to improve the thermal efficiency of a fossil fuel power plant. The thermal efficiency of a CT/HRSG system, hereafter referred to as "thermal efficiency" or "$\eta_{CT/HRSG}$", can be defined as:

$$\eta_{CT/HRSG} = \frac{\text{Gross Shaft Power } (CT) + \text{Useful Energy Flow Delivered}}{\text{Fuel Energy Flow} + \text{System Energy Flow Credits}} \quad (1)$$

In a simple CT/HRSG system where no recovery boiler is used only the gross shaft power produced from the combustion turbine would appear in the numerator of Equation 1, as the term "Gross Shaft Power (CT)". In a CT/HRSG system, which uses a recovery boiler, both the gross shaft power produced by the combustion turbine, and a second factor representing the useful energy flow delivered from the hot combustion products to a secondary fluid circulated in a recovery boiler appear in the numerator. The secondary fluid is circulated in the recovery boiler of the CT/HRSG system.

The gross shaft power represents the electrical or mechanical power produced by the turbine or turbines of the combustion turbine system. The gross electrical power produced is measured at the generator's terminals. When considering generation of electricity, the gross shaft power produced is the gross electrical power plus generator losses, and/or mechanical losses between the shaft and the point of measurement. The shaft's bearing losses, gear losses and other frictional losses are accounted for through a separate term.

The useful energy flow delivered represents the energy flow transferred from the combustion gases (the primary fluid) to a secondary fluid; or other use of this energy flow directly for a useful purpose as opposed to exhausting it to the environment. This second numerator term in Equation 1 is comprised of secondary fluid flow through the recovery boiler times the difference in outlet to inlet fluid enthalpy, plus kinetic energies differences, and plus potential energies differences of the secondary fluid. In addition, if the recovery boiler employs supplementary firing of fuel, the supplementary fossil fuel energy flow must be added to the denominator of Equation 1 with the turbine's fuel energy flow.

If the combustion turbine system employs additional equipment, for example an auxiliary turbine (for example a steam turbine) driven by the secondary fluid, the expression for total system efficiency combines $\eta_{CT/HRSG}$ with the efficiency of the auxiliary turbine and the expression of total combustion turbine system efficiency becomes:

$$\eta_{system} = \eta_{CT/HRSG}\ \eta_{aux\text{-}turbine}\ \eta_{shaft} \quad (2)$$

The term $\eta_{aux\text{-}turbine}$ is defined herein to maintain the consistency of $\eta_{CT/HRSG}$. If no auxiliary turbine is employed, then the term $\eta_{aux\text{-}turbine}$ is unity. Once base terms have been determined using the methods of this invention, any ancillary definitions of efficiencies could be used as convenience warrants in defining system efficiencies.

The $\eta_{aux\text{-}turbine}$ term represents auxiliary steam turbine thermal efficiency. The $\eta_{shaft}$ term represents a shaft conversion efficiency of outputs divided by inputs. The Equation 2 terms are defined, as suggested by the ASME Power Test Codes 4.1 and 6, as a power or useful energy flow output divided by a energy flow input. In the equations below "UEF" is an abbreviation for "Useful Energy Flow". UEF is the total energy flow from the hot combustion gases, a secondary fluid, and/or a secondary fluid used outside the system after expansion in an auxiliary turbine.

$$\eta_{aux\text{-}turbine} = \frac{\text{Gross Shaft Power } (CT) + \text{Gross Shaft Power } (Aux) + UEF}{\text{Gross Shaft Power } (CT) + \text{Useful Energy Flow}} \quad (3A)$$

$$\eta_{shaft} = \frac{\text{Net Useful Power } (CT) + \text{Net Useful Power } (Aux) + UEF}{\text{Gross Shaft Power } (CT) + \text{Gross Shaft Power } (Aux) + UEF} \quad (3B)$$

Applicability To Any Fossil Fuel Power Plant

It is evident from the above discussion that all the terms of the equations set forth above can be derived from and applied to any fossil fuel system producing power or a useful energy flow. Thus, the method of this invention is applicable to a CT system and to a HRSG System. In a HRSG system, a boiler produces a useful energy flow by heating a secondary fluid such as steam or a steam/water combination. The method of the invention is also applicable to a conventional fossil fuel system comprising a boiler cycle and a turbine cycle. In the boiler a fluid such as liquid water is heated to make steam by the heat produced by combusting a fossil fuel, which steam is then delivered to a turbine. The turbine can produce mechanical or electrical power.

The following substitutions and definitions are set forth to assist an understanding of how the disclosed method can be applied to a conventional fossil fueled boiler producing useful energy flow by heating a secondary fluid. Without use of a combustion turbine there is obviously no shaft power developed directly from the combustion gases, thus in Equations 1, 3A & 3B; Gross Shaft Power (CT)=Net Useful Power (CT)=0.0; the turbine cycle's output is substituted for the auxiliary power terms; and the definition, formulation and usage of boiler efficiency is identical to CT/HRSG efficiency, $\eta_{boiler}=\eta_{CT/HRSG}$; both termed thermal efficiency. Thus to summarize, for a conventional fossil fuel power plant:

$$\eta_{turbine\text{-}cycle} = \eta_{aux\text{-}turbine}\eta_{shaft} \quad (3C)$$

$$= \frac{\text{Net Useful Power } (Aux) + \text{Useful Energy Flow}}{\text{Useful Energy Flow Delivered to Turbine Cycle}} \quad (3D)$$

$$\eta_{system} = \eta_{boiler}\eta_{turbine\text{-}cycle} \quad (3E)$$

Overview Of The Method

The definition of thermal efficiency of Equation 1 can be applied to circumstances of continuous monitoring of thermal performance, if the fuel flow and other parameters comprising $\eta_{CT/HRSG}$ can be determined or measured accurately. Even if so monitored, a directly measured input fossil fuel flow can be measured and the resultant CT/HRSG or thermal efficiency compared to that calculated by the disclosed method. The method of this invention computes $\eta_{CT/HRSG}$ only after Equation 1 has been reformulated so that a direct measurement of the "Fuel Energy Flow" term (which is the same as input fuel mass flow times heating value) has been calculationally excluded by obtaining indirectly the fuel flow term.

After excluding the input fossil fuel flow term, three major deficiencies in the knowledge of a CT/HRSG system's thermodynamic process remain and must be addressed to solve Equation 1 by the disclosed method: (1) the complexities of the compressor of the combustion turbine system, the combustion process of burning fossil fuel and the turbine proper; (2) the specification of thermal losses not directly related to the combustion process (which could affect a measured fossil fuel flow); and (3) with a HRSG system where a recovery boiler is used, the complexities of heat transfer by convection and radiation in intricate geometries and if applicable, the firing of a HRSG system with supplementary fuel. With the exception of the compressor and turbine of a combustion turbine system, such problems exist in any fossil fuel thermal system.

I have developed a method to overcome these deficiencies. This method separates the definition of thermal efficiency into certain components which when taken separately permit one to calculationally exclude the first of the three problem areas set forth above. Thus, thermal efficiency is separated into a combustion efficiency, $\eta_C$, term, and an absorption efficiency, $\eta_A$, term. Use of $\eta_C$ allows consideration of only input and output terms which can be measured with high accuracy, thus eliminating any need for resolution of a turbine's internal thermodynamic complexities. The use of $\eta_A$ allows for the consideration of only "non-stack" losses, losses which generally have minor impact on system or thermal efficiency, thus whose understanding does not require high resolution. Major losses in any fossil-fired power plant are associated with hot gas effluent (i.e., stack losses) and shaft inefficiencies. The problem of describing the complexities of convection and radiation heat transfer is solved by calibrating internal correlations to actual test data. Supplementary firing is addressed through the $\eta_C$ term by combining all fuel supplies.

Equation Term Definitions

Typical units of measurement are defined below:

$m_{AF\text{-}i}$ ≡ As-Fired Fuel Mass Flow Rate (of a specific fuel); $lb_{AF\text{-}i}$/hr.

MF ≡ Total As-Fired Fuel Mass Flow Rate (to the combustion turbine (CT), and to the recovery boiler as supplementary fuel (SU) ); $lb_{AF}$/hr.

≡ $m_{AF\text{-}CT} + m_{AF\text{-}SU}$ $HHVP_i$ ≡ Higher Heating Value at Constant Pressure (of a specific fuel); Btu/$lb_{AF\text{-}i}$.

HV ≡ $HHVP_{CT} + (\epsilon)HHVP_{SU}$ $\epsilon$ ≡ $m_{AF\text{-}SU}/m_{AF\text{-}CT}$ $HSEC_i$ ≡ specific system energy credits; Btu/$lb_{AF\text{-}i}$ HC ≡ $HSEC_{CT} + (\epsilon)HSEC_{SU}$ EF ≡ Fuel Energy Flow (fuel flow × higher heating value at constant pressure); Btu/hr.

≡ $m_{AF\text{-}CT}\ HHVP_{CT} + m_{AF\text{-}SU}\ HHVP_{SU} = m_{AF\text{-}CT}HV$ CF ≡ System Energy Flow Credits (CT fuel flow × specific energy credits relative to the system); Btu/hr.

≡ $m_{AF\text{-}CT}\ HSEC_{CT} + m_{AF\text{-}SU}\ HSEC_{SU} = m_{AF\text{-}CT}\ HC$ HPR ≡ Enthalpy of the Combustion Products (includes the heat of formation plus $\int C_p dT$ at the stack); Btu/$lb_{AF}$.

$HRX_i$ ≡ Enthalpy of the Reactants (based on the heating value, sensible heating and energy credits); Btu/$lb_i$.

HSL ≡ Specific Stack Losses (includes losses directly effecting the energy released during combustion, defined by PTC 4.1: $L_G$, $L_{mF}$, $L_H$, $L_{mA}$, $L_X$, $L_Z$, $L_{CO}$, $L_{UH}$ & $L_{UHC}$; all divided by MF); Btu/$lb_{AF}$.

HNSL ≡ Specific Non-Stack Losses (turbine and recovery boiler losses whose mechanisms originate from the combustion process or from the hot gases, and interface directly with the environment thus a direct effect on the BBTC term; defined by PTC 4.1 as: $L_\beta$ $L_p$, $L_d$, $L_r$& $L_{UC}$; defined by PTC 4.4 as: $L_\beta$& $L_w$; in addition to the turbine's shaft bearing losses, applicable gear losses and other similar frictional losses associated with delivery of useful shaft power; all divided by MF); Btu/$lb_{AF}$.

ERC = Energy Released during Combustion; Btu/hr.

= EF + CF − Σ(Stack Losses)

= EF + CF − (MF)HSL

= (MF)(HPR) − $m_{AF\text{-}CT}\ HRX_{CT} - m_{AF\text{-}SU}\ HRX_{SU}$

= $m_{AF\text{-}CT}\ [(1 + \epsilon)HPR - HRX_{CT} - \epsilon HRX_{SU}]$

BBTC = Gross Shaft Power (CT) + Useful Energy Flow Delivered

= ERC − Σ(Non-Stack Losses)

= ERC − (MF)HNSL

Application To A Combustion Turbine System

With these variable definitions, equivalent ways to express thermal efficiency include the following:

$$\eta_{CT/HRSG} = \frac{BBTC}{EF + CF} \quad (4)$$

$$\eta_{CT/HRSG} = \frac{ERC - \Sigma(\text{Non-Stack Losses})}{EF + CF} \quad (5)$$

$$\eta_{CT/HRSG} = \frac{(EF + CF) - \Sigma(\text{Stack Losses}) - \Sigma(\text{Non-Stack Losses})}{EF + CF} \quad (6)$$

$$\eta_{CT/HRSG} = \frac{ERC}{EF + CF}\left\{1.0 - \frac{\Sigma(\text{Non-Stack Losses})}{ERC}\right\} \quad (7)$$

As discussed above, the definition, formulation and usage of boiler efficiency as would apply for a conventional boiler is identical to $\eta_{CT/HRSG}$; thus $\eta_{boiler}$=BBTC/(EF+CF).

Significantly, Equation 7 indicates that thermal efficiency can be divided into two separate efficiencies: one descriptive of the combustion process per se (called the combustion efficiency), and the other descriptive of certain non-stack losses (called the absorption efficiency). As will be seen below, these non-stack losses describe surface radiation and convention losses (the term $L_B$), heat losses in circulating pump cooling water and miscellaneous coolant ($L_W$), and losses associated with delivery of gross shaft power. If the recovery boiler uses coal fuel for supplementary heating, then losses commonly associated with a conventional coal-fired boiler are applicable (defined above via PTC 4.1).

The combustion efficiency definition is suggested by the In/Out Method defined in PTC 4.1 or in PTC 4.4: that is, net energy released at the thermodynamic boundary to the system divided by the total energy flow input (the fuel's energy flow and system energy flow credits).

The following develops $\eta_C$ on a unity fuel flow basis:

$$\eta_c = 1 - \frac{\Sigma(\text{Stack Losses})}{EF + CF} = 1 - \frac{(1+\epsilon)HSL}{HV + HC} \quad (8)$$

$$\eta_c = \frac{(EF + CF) - \Sigma(\text{Stack Losses})}{EF + CF} \quad (9)$$

$$\eta_c = \frac{ERC}{EF + CF} \quad (10)$$

$$\eta_c = \frac{m_{AF\text{-}CT}[(1+\epsilon)HPR - HRX_{CT} - \epsilon HRX_{SU}]}{m_{AF\text{-}CT}HV + m_{AF\text{-}CT}HC} \quad (11)$$

$$\eta_c = \frac{(1+\epsilon)HPR - HRX_{CT} - \epsilon HRX_{SU}}{HV + HC} \quad (12)$$

In these expressions HPR is the enthalpy of the combustion products and HRX is the enthalpy of the reactants. It should be noted that the combustion efficiency is also composed of "losses," indeed the ERC term represents turbine losses, stack losses, and energy credit terms.

The absorption efficiency is derived from the Heat Loss Methods found in the Power Test Codes although limited to non-stack energy terms. It must be referenced to the Energy Released during Combustion term (ERC) if all losses (on a systems bases) are to be additive when calculating the thermal efficiency:

$$\eta_A = 1 - \frac{\Sigma(\text{Non-Stack Losses})}{\eta_c(EF + CF)} \quad (13)$$

The quantity $\eta_C$(EF+CF) defines the ERC term, see definitions and Equation 10 above, thus:

$$\eta_A = 1 - \frac{(MF)HNSL}{ERC} \quad (14)$$

-continued $$\eta_A = 1 - \frac{(1+\epsilon)HNSL}{(1+\epsilon)HPR - HRX_{CT} - \epsilon HRX_{SU}} \quad (15)$$

$$\eta_A = \frac{(1+\epsilon)HPR - HRX_{CT} - \epsilon HRX_{SU} - (1+\epsilon)HNSL}{(1+\epsilon)HPR - HRX_{CT} - \epsilon HRX_{SU}} \quad (16)$$

Non-stack losses, HNSL, is based on unity total fuel flow rate, a specific energy term. The components of HNSL are numerically identical to definitions afforded by PTC 4.1 and PTC 4.4 for non-stack losses plus turbine shaft losses. From Equation 15 HNSL is seen to be related to the Energy Released during Combustion term (ERC) reduced by the factor $(1-\eta_A)$, given as:

$$(1+\epsilon)HNSL = [(1+\epsilon)HPR - HRX_{CT}\epsilon HRX_{SU}](1-\eta_A) \quad (17)$$

The following set of equations demonstrates that using the concepts of stack losses and non-stack losses, as defined above (see Equation 8 and Equation 13), the definition of thermal efficiency, $\eta_{CT/HRSG}$, is readily developed:

$$\eta_{CT/HRSG} = \eta_C\eta_A \quad (18A)$$

$$\eta_{CT/HRSG} = \left\{1 - \frac{\Sigma(\text{Stack Losses})}{EF + CF}\right\} \times \left\{1 - \frac{\Sigma(\text{Non-Stack Losses})}{\eta_C(EF + CF)}\right\} \quad (18B)$$

$$\eta_{CT/HRSG} = 1 - \frac{(1+\epsilon)HSL}{(HV + HC)} - \frac{(1+\epsilon)HNSL}{\eta_C(HV + HC)} + \frac{(1+\epsilon)^2 HSL\, HNSL}{\eta_C(HV + HC)^2} \quad (18C)$$

$$\eta_{CT/HRSG} = 1 - \frac{(1+\epsilon)HSL}{(HV + HC)} - \frac{(1+\epsilon)HNSL}{\eta_C(HV + HC)}\{1 - (1+\epsilon)HSL/(HV + HC)\} \quad (18D)$$

$$\eta_{CT/HRSG} = 1 - \frac{(1+\epsilon)HSL}{(HV + HC)} - \frac{(1+\epsilon)HNSL}{(HV + HC)} \quad (18E)$$

$$\eta_{CT/HRSG} = 1 - \frac{\Sigma(\text{Total } CT/HRSG \text{ System Losses})}{(EF + CF)} \quad (18F)$$

Equation 18F is, of course, identically equal to Equation 1 which is based on the classical definition of CT/HRSG System efficiency.

It should be noted that the quantity HSL includes the following PTC 4.1 terms relating stack losses to total as-fired fuel flow rate:

$$(MF)HSL = L_G + L_{mF} + L_H + L_{mA} + L_X + L_Z + L_{CO} + L_{UH} + L_{UHC} \quad (19)$$

The quantity HNSL includes the following PTC 4.1 terms, PTC 4.4 terms, and terms relating to turbine losses (energy flow losses in delivering gross shaft power):

$$(MF)HNSL = L_{B\text{-}4.1} + L_p + L_d + L_r + L_{UC} + L_{B\text{-}4.4} + L_W + (\text{shaft losses}) \quad (20)$$

The combination of the combustion efficiency and absorption efficiency is the overall thermal efficiency, as suggested by the Power Test Codes. The following, using direct energy flow terms, as opposed to using the system loss terms of Equation 18, again demonstrates the derivation of thermal efficiency (see Equation 12 and Equation 16):

$$\eta_{CT/HRSG} = \eta_C\eta_A \quad (21A)$$

-continued $$\eta_{CTHRSG} = \frac{(1+\epsilon)HPR - HRX_{CT} - \epsilon HRX_{SU}}{HV + HC} \times \frac{(1+\epsilon)HPR - HRX_{CT} - \epsilon HRX_{SU} - (1+\epsilon)HNSL}{(1+\epsilon)HPR - HRX_{CT} - \epsilon HRX_{SU}} \quad (21B)$$

$$\frac{(1+\epsilon)HPR - HRX_{CT} - \epsilon HRX_{SU} - (1+\epsilon)HNSL}{HV + HC} \quad (21C)$$

$$\eta_{CTHRSG} = \frac{BBTC}{m_{AF\text{-}CT}(HV + HC)} \quad (21D)$$

Terms in Equation 21D can be rearranged to solve for the combustion turbine's mass flow rate, $m_{AF\text{-}CT}$, by the following:

$$m_{AF\text{-}CT} = \frac{BBTC}{\eta_{CTHRSG}(HV + HC)} \quad (21E)$$

Note that in Equation 21E when the ratio $m_{AF\text{-}SU}/m_{AF\text{-}CT}$ is considerably less than unity, as might affect the terms HV and HC, its approximation (if lacking instrumentation to measure $m_{AF\text{-}SU}$ directly) would not seriously effect the accuracy of the computed $m_{AF\text{-}CT}$.

By separating thermal efficiency into combustion efficiency and absorption components, the analyst has knowledge as to where degradations are occurring. If combustion efficiency decreases (stack losses increase), the plant engineer would consider: fuel-air mixing equipment, degradation of hardware directly interfaced with delivery of the combustion air, low heat content in the fuel, improper operation of the fuel's burner mechanism, improper operation of the combustion proper such as the location of the fire-ball, etc.—all sources directly affecting the combustion process (i.e., stack losses). The terms comprising combustion efficiency can be easily reduced to a unit basis of total as-fired fuel, refer to Equation 12; as such these terms have the potential to be determined with great accuracy. HV is the corrected, weighted average, higher heating value; HC is the system's energy credit term; HPR and HRX are the energy of products and reactants based on accurate properties, consistent properties and HV.

In a similar manner, if the absorption efficiency decreases (non-stack losses increase), consideration should be given to terms affecting this efficiency: radiation & convection losses, turbine bearing losses if extracting power directly from the combustion gases, heat exchanger water/steam leaks, heat exchanger effectiveness, etc. The absorption efficiency also has the potential to be determined with high accuracy. As a minimum, this term is generally a large number (approaching unity) thus its error is no greater than its compliment (if $\eta_A$=98%, its maximum error is ±2%). Although $\eta_A$ is dependent (through the term ERC) on $\eta_C$; and a given degradation in $\eta_C$ will effect $\eta^A$, the impact on relative changes is generally small. Also, by iteration technique, $\eta_A$ can be resolved without a priori knowledge of fuel flow rate. Thus, both $\eta_C$ and $\eta_A$, therefore $\eta_{CT/HRSG}$, can be determined independent of fuel flow.

The enthalpy of the products (HPR) can be accurately calculated using thermodynamic properties:

$$HPR = \Sigma\, n_i h_{PROD\text{-}i}/(XN_{AF}) \quad (22)$$

$$h_{PROD\text{-}i} = H_{fi} + H_{fg} + h_{Ti} - h_{Ref} \quad (23)$$

where:

$n_i$ = Molar quantity of $i$ per 100 moles of dry gas effluent.

$x$ = Moles as-fired fuel per 100 moles of dry gas effluent.

$N_{AF}$=Molecular weight of as-fired fuel.

$H_{fi}$=Heat of formation of i.

$H_{fg}$=Latent heat of water.

$h_{Ti}$=Enthalpy of i at the stack, at stack temperature T.

$h_{Ref}$=Enthalpy at the calorimetric temperature (77° F.).

Note that $h_{Ti} - h_{Ref\text{-}i} = \int C_p dT$, as evaluated from a reference temperature to the stack exit temperature.

The energy content of the reactants is determined by using the fundamental definition of heat value, as it is related to the difference between ideal products of combustion and the actual enthalpy of reactants at the calorimetric temperature.

$$\int \delta Q = -HHVP \quad (24)$$

$$= HPR_{Ideal} - HRX_{Ref} \quad (25)$$

Equation 25 is used to backcalculate for $HRX_{Ref}$ which is then corrected for system effects. These effects, in the order presented in Equation 26, include: the relative energy of combustion air as output from the compressor ($\Delta h_A$); relative energy of water/steam in-flow to the process ($\Delta h_2$); the sensible energy in the as-fired fuel ($\Delta h_F$); boiler credits associated with out-of-envelope sources ($\Sigma B_i$, defined by PTC 4.1 and PTC 4.4); and the chemical energy contained in reactant water found in the air's moisture ($b_A$) and the chemical energy contained in the inflow of water/steam used by the CT/HRSG System ($b_Z$).

$$\begin{aligned} HRX = {} & HRX_{Ref} + \Delta h_A + \Delta h_Z + \Delta h_F + \\ & (B_X + B_W - L_W + B_{Fan})/m_{AF} + \\ & b_A(1.0 + \beta)N_{H_2O}(H_{f\text{-}H_2O} + H_{fg})/(xN_{AF}) + \\ & b_Z N_{H_2O}(H_{f\text{-}H_2O} + H_{fg})/(xN_{AF}) \end{aligned} \quad (26)$$

Ideal products from any hydrocarbon fuel are comprised solely of $CO_2$, $H_2O$ and $SO_2$. Thus, if the heating value is measured with care, the enthalpy of the reactants at the calorimetric temperature can be determined with accuracy:

$$HRX_{Ref} = HHVP + HPR_{Ideal} \quad (27)$$

$$\begin{aligned} HRX_{Ref} = {} & HHVP + H_{f\text{-}CO_2}(\alpha_0 YR + \alpha_4 + \alpha_7 + \alpha_8)/N_{AF} + \\ & H_{f\text{-}H_2O}(\alpha_0 ZR + 2\alpha_2 + 2\alpha_5 + 2\alpha_9)/2N_{AF} + \\ & H_{f\text{-}SO_2}(\alpha_6 + \alpha_9)/N_{AF} \end{aligned} \quad (28)$$

Thus, the substitution of Equation 28 into Equation 26 allows the determination of HRX for the actual "as-fired" conditions. The molar quantities described by $\alpha_i$ in these equations relate to the fuel's constituents and are defined below; as used in Equation 28 they describe the ideal moles of product given complete combustion. The $\beta$ term used in Equation 26, etc., relates to air in-leakage into the gas path, and is defined such that $\beta$ moles of air in-leakage cross the boundary per mole of true combustion air. Environmentally sensitive terms are defined as $\Delta h_A$ (the relative enthalpy of the combustion air and its moisture), $\Delta h_Z$ (the relative energy of all CT/HRSG System in-leakage of water/steam), and $\Delta h_F$ (the fuel's sensible heat). In total, these quantities correct the HRX term from the calorimetric temperature (77° F.) to the actual inlet conditions of the as-fired fuel, account stoichiometrically for all water/steam inputs (combustion air, turbine injections, recovery boiler in-leakages, and the like), and account for system energy credits.

The basic stoichiometric equation relating reactants to products is presented as Equation 29. The quantities comprising the combustion equation are traditionally based on an assumed 100 moles of dry gaseous product. This assumption is useful when measuring stack emissions since the commonly measured concentrations are based on dry molar fractions. The combustion equation used is truly a "systems" equation describing boundary stoichiometrics:

$$x[\alpha_0(C_{YR}H_{ZR}) + \alpha_1(N_2) + \alpha_2(H_2O) + \alpha_3(O_2) + \alpha_4(C) + \alpha_5(H_2) + \alpha_6(S) + \alpha_7(CO_2) + \alpha_8(CO) + \alpha_9(H_2S) + \alpha_{10}(ash)] + [a(O_2) + \phi_{Ref}a(N_2) + b_A(H_2O)][1.0 + \beta] + b_Z(H_2O) = d(CO_2) + e(CO) + f(H_2) + g(O_2) + h(N_2) + j(H_2O) + x\alpha_{10}(ash) + k(SO_2) + l(SO_3) + m(NO) + p(N_2O) + q(NO_2) + t(C_{YP1}H_{ZP1}) + u(C_{YP2}H_{ZP2}) + v(C_{Refuse}) + w(C_{Reject}) + a\beta(O_2) + \phi_{Ref}a\beta(N_2) + b_A\beta(H_2O) \quad (29)$$

The following defines nomenclature used in Equation 29. Note that all are molar quantities:

$x$ = As-fired fuel per 100 moles of dry gas product
$\alpha_i$ = Fuel constituents per unity moles of as-fired fuel, $\Sigma\alpha_i = 1.00$.
$a + \phi_{Ref}a$ = Dry combustion air, as-fired.
$a\beta + \phi_{Ref}a\beta$ = Dry air from in-leakage anywhere in the system up to the point of stack measurement (i.e., thermodynamic boundary).
$b_A$ = Moisture in the entering combustion air.
$b_A\beta$ = Moisture from air in-leakage relative to the stack measurement (i.e., thermodynamic boundary).
$b_z$ = Water/stream in-leakage from all sources.
$n_i$ = Molar quantities of dry flue gas related to specific compounds: d, e, f, g, h, k, l, m, p, q, t and u; the sum denoted as $\Sigma n_i$. For example, "f" is the moles of $H_2$ in the flue gas per 100 moles of dry gas product, "t" is the moles of unburned hydrocarbon (#1) per 100 moles of dry gas, etc.
$n_{ii}$ = Molar quantities of non-gas product compounds: j, $xa_{10}$, v, w, $b_A\beta$; the sum denoted as $\Sigma n_{ii}$.
$\beta$ = Air in-leakage factor, a molar ratio.
$\phi_{Ref}$ = Ratio of nitrogen to oxygen in combustion air.

Resolution of Equation 29 proceeds in typical fashion, solving for all $n_i$ and $n_{ii}$ quantities. At least two cases are always analyzed by a preferred embodiment of the disclosed method: an "actual" case (using the unaltered input data), and an "error" analysis case which produces a consistency check on the input stack gas concentrations (in essence an error on $\eta_C$). Results from the error analysis are used in-part for convergence checks for the combustion efficiency iterations. The importance and functionality of Equation 29 to the process of determining fuel flow and system efficiencies lies in the fact that total consistency of a molar (thus mass) balance is inherent in its formulation.

To summarize, the disclosed method permits determination of a CT or CT/HRSG system thermal efficiency based on effluent measurement data, fossil fuel heating value and several parameters of minor importance which are routinely monitored by power plant operations personnel.

Fuel Flow And Emissions Flows

A fossil fuel can have a unique chemical composition. When combusted a fossil fuel can yield unique product stoichiometrics, that is, unique relative molar concentrations of different effluent combustion gases. The principal gaseous effluents from fossil fuel combustion are $N_2$, $CO_2$, $H_2O$ and $O_2$. $H_2O$, when effluent from combustion, is commonly in its superheated phase thus acting as a gas (when stack gas is measured it can be cooled before analyzed, if so, the water is condensed, so that the $CO_2$ and $O_2$ gas concentrations are measured on a dry basis. $N_2$ in the effluent gas comes from principally the air used to burn the fuel and it has little chemical reactiveness, thus its sensitivity to the fuel's chemical composition is not significant. However, the relative concentrations of carbon and hydrogen found in any fossil fuel can have a significant impact on the relative concentrations of $CO_2$ and $H_2O$ found in the effluent gas, as coupled to the relative quantities of free $O_2$ used to burn the fuel. This implies that the molar fractions of $CO_2$, $H_2O$ and $O_2$ present in the effluent are unique relative to the fuel input and supplied combustion air. Gas and oil as hydrocarbon fuels contain significant quantities of both carbon and hydrogen, which are bound chemically. Coal can be used for supplementary firing of the recovery boiler of a HRSG system or in the combustor of a combustion turbine system. Coal also contains carbon and hydrogen bound mechanically and chemically, and also quantities of free water (and can range from 2 to 45 percent by weight). Water is found naturally in coal, and although the coal can be dried, it is not practical to totally remove the moisture. Thus, for any fossil fuel system, if accurate measurements are made of the $CO_2$, $H_2O$ and $O_2$ effluent, then not only can the $\eta_C$ term be calculated accurately, but inherent consistency checks are afforded through stoichiometric considerations involving carbon, hydrogen and oxygen balances.

If multiple fuel types are combusted the dry analysis of the composite fuel can be difficult to obtain with high accuracy for continuous or even routine monitoring. The present method can be used to confirm changes in the coal's chemical makeup, and under certain conditions can be used to back-calculate the carbon to hydrogen ratio in the fuel. In its simplest form the present method can rely on a priori knowledge of a fossil fuel's dry chemical analysis, if the dry analysis is relatively constant this assumption is adequate. However, the method of the present invention can also alter the as-fired fuel heating value based on high accuracy $CO_2$ and $H_2O$ measurements in the effluent. For the calculational aspects of the method discussed herein, the heating value is input on a dry fossil fuel basis; the calculational process iterates for the water content in the incoming fuel until the measured stack $H_2O$ agrees with the stoichiometrically determined value. Using basic stoichiometric relationships coupled with high accuracy effluent measurements, the carbon to hydrogen ratio can be updated. With this ratio, on-line variations to a reference heating value can be determined through normalization. The normalization involves use of a correlation relating carbon, hydrogen, oxygen and sulfur contents to a dry-base heating value then correcting for water. Note that the fuel water is corrected only in consideration of other sources of water such as turbine injection, system leakages, etc. This correlation is taken from the works of Ghamarian & Cambel, which is based in-part on the well known work of Szargut and Szargut & Stryrylska. The references include: A. Ghamarian & A. B. Cambel, *Energy/Exergy Analysis of Fluidized Bed Combustor*, Proceedings of the Intersociety Energy Conversion Engineering Conference, Aug. 8–12, 1982, pp. 323–327; A. Ghamarian & A. B. Cambel, *Exergy Analysis of Illinois No. 6 Coal*, Energy, Vol. 7, No. 6, 1982, pp. 483–488; J. Szargut, *International Progress in Second Law Analysis*, Energy, Vol. 5, 1980, pp. 709–718; and J. Szargut & T. Stryrylska, *Approximate Determination of the Exergy of Fuels*, Brennstoff-Warme-kraft, Vol. 16, No. 12, December 1964, pp. 589–596. The correlation is accurate to within ±0.7% ΔHHV deviation for over four dozen short- and long-chained hydrocarbon compounds. For coal, and as demonstrated below, having a low oxygen content the correlation's accuracy is estimated at ±0.5%. A similar correlation exists for coal with high oxygen content. The method calculates a term $\Delta HHV_{Ref}$ based on a reference dry-based heating value of nominal fuel, using reference concentrations of carbon, hydrogen, oxygen and sulfur. With the term $\Delta HHV_{Ref}$ and use of Equation 31 or Equation 32, the on-line heating value is then computed via Equation 33. Oxygen and sulfur, given their small molar concentrations, can be assumed constant. The following equations are normalized to dry fossil fuel data (which data can be used as input to a FUEL INPUT FILE (a computer program used to itself prepare input for an EX-FOSS™ program, described supra); the term $N_{AF}$ is the molecular weight of the as-fired (wet-based) fuel, which molecular weight is determined automatically by the EX-FOSS™ computer program.

$$\Delta HHV_{Ref} = HHV_{Ref/dry} - (-178387.18\alpha_3 + 183591.92\alpha_4 + 78143.68\alpha_5 + 127691.99\alpha_6 - \alpha_5 N_{H2O}\Delta h_{fg})_{Ref}/(N_{AF} - \alpha_2 N_{H2O})_{Ref} \quad (30)$$

$$LHV_{on\text{-}line/dry} = (-178387.18\alpha_3 + 183591.92\alpha_4 + 78143.68\alpha_5 + 127691.99\alpha_6)/(N_{AF} - \alpha_2 N_{H2O}) \quad (31)$$

If the power system has measured dry heating values associated with different fuels being used, then a specific correlation for the dry lower heating value can be established as a function of carbon, hydrogen, oxygen and sulfur concentrations. This process is recommended only if the error without special characterization exceeds ±1.0%. Such a correlation can be written in the following form, where the $C_i$ constants are determined by fitting routines:

$$LHV_{on\text{-}line/dry} = (C_3\alpha_3 + C_4\alpha_4 + C_5\alpha_5 + C_6\alpha_6)/(N_{AF}\alpha_2 N_{H2O}) \quad (32)$$

The as-fired heating value (i.e., a total wet-base) is given by:

$$HHV_{AF} = (LHV_{on\text{-}line/dry} + \Delta HHV_{Ref})(N_{AF} - \alpha N_{H2O})/N_{AF} + (\alpha_2 + \alpha_5)N_{H2O}\Delta h_{fg}/N_{AF} \quad (33)$$

where the water content term, $\alpha_2$, is iterated until convergence is achieved. The various terms comprising these equations, if not evaluated with precision, can lead to error in the calculated heating value and fuel flow rate. Note however that the sign of the error introduced by the heating value will always have an opposite change in the calculated fuel flow, given an unique energy flow to the secondary fluid. The net effect on the CT/HRSG System energy flow is of course diminished—errors offset each other. This process results in a factor of five dilution effect. For example, a +0.52% change in HHV will affect fuel flow by −0.61%, but thermal efficiency and thus system thermal efficiency by only +0.12% $\Delta\eta$. When defining thermal or CT/HRSG efficiency, $\eta_{CT/HRSG}$, the HHV term is used in developing the enthalpy of reactants, the numerator term of Equation 12; it also appears in $\eta_{CT/HRSG}$'s denominator, see Equation 18 and Equation 21C.

Thus, the disclosed method for improving thermal efficiency involves the measurement of gross electrical or mechanical power produced and net energy flow to the secondary fluid, an exhaust gas temperature at the stack, the input fossil fuel's chemical composition without water (i.e. on a dry basis), the fuel's heating value on a dry bases, and $CO_2$, $H_2O$ and $O_2$ gaseous effluent concentrations in the stack.

The $CO_2$ and $H_2O$ concentrations are not input into the EX-FOSS™ program, they are computed based on stoichiometrics. However the stack $O_2$ concentration, concentration of the common pollutants (i.e. CO, $SO_2$ and NO), and other minor data, is supplied input. Using EX-FOSS™ in an iterative manner with this basic input data, complete stoichiometrics are computed including $CO_2$ and $H_2O$. The computed quantities of $CO_2$ and $H_2O$ are then compared to the measured, if they agree then stoichiometric consistency is had and thermal efficiency is computed correctly. If the $CO_2$ and $H_2O$ concentrations do not agree, and little or no water is present in the fuel (i.e., using a gas or oil fuel), and no water is injected or leaks into the system, then measurement errors must be present. For gas or oil fuel used in a combustion turbine, without water/steam injection, the situation of inconsistent calculations is unusual, the fault will generally lie with the $O_2$ stack measurement. If the $CO_2$ and $H_2O$ concentrations do not agree, and water/steam is present in the fuel and/or is injected and/or leaks into the system, then the mass flow of water/steam as an input to the system is varied until agreement is reached. This latter scenario is especially applicable to a CT/HRSG System using injected water/steam; it does however require that the measurement of stack $CO_2$, $H_2O$ and $O_2$ be maintained to high precision.

As indicated, the disclosed method permits an input fossil fuel flow into a combustor of a system producing a useful energy flow and/or power, such as a CT or CT/HRSG system, to be determined by a combination of measured data and calculationaly obtained values. The input fuel flow is not directly measured but is determined by ascertaining mass and energy balances based on unity fuel flow rate, by using highly accurate thermodynamic properties of combustion gases, by measurement of the gross electrical or mechanical power produced, by measurement of the net energy flow supplied to the secondary fluid from a recovery boiler, and by recognizing the integral relationship of effluent $CO_2$, $H_2O$ and $O_2$ to the chemical composition of input fuel. A determination of the fuel flow allows routine tracking of a fossil-fired plants' overall thermal efficiency and a continuous correction program for problems impacting thermal efficiency.

By knowing the fuel flow rate and the complete stoichiometric relationships, individual emission (i.e. constituent gases) flow rates, $m_{species\text{-}i}$ (lb/hr), can be determined as follows:

$$m_{species\text{-}i} = (MF)\Phi_i N_i/[xN_{AF}] \quad (34)$$

where $\Phi_i$ is the molar fraction of an effluent species (or constituent gas) on a dry-bases, MF is the computed as-fired total fuel flow rate, x is the molar quantity of as-fired fuel per stoichiometric dry-base and $N_i$ & $N_{AF}$ are molecular weights of the species, i, and the as-fired fuel. The terms $\Phi_i$ derive directly from solution of the right-hand terms of Equation 29 as discussed above, for example $\Phi_{SO2}$=k. The emission rate per species, in units of pounds per million Btu of fuel energy input, termed $ER_i$, is given by the following:

$$ER_i = 10^6 m_{species\text{-}i}/(EF) \quad (35A)$$

$$= 10^6 \Phi_i N_i/[xN_{AF}(HV)] \quad (35B)$$

Note that an emissions rate of a particular effluent can be evaluated independently of the as-fired total input fossil fuel flow rate. However, the computational accuracy of the fuel flow rate, as determine using the processes of this patent, intrinsically affects the emissions rate through $\Phi$, x and $N_{AF}$. Further, the disclosed method allows the determination of total dry volumetric flow, at standard conditions, of gaseous effluent, denoted by VF, as required by environmental regulations. VF is determined by the following (in standard-ft$^3$/hr):

$$VF=\rho_{gas}(MF)N_{gas}/[xN_{AF}] \quad (36)$$

where $\rho_{gas}$ and $N_{gas}$ are the standard density and average molecular weight of the effluent dry gas. Of course, to determine the mass flow of all effluents Equation 34 can be summed.

Thus, as shown by Equation 36, the independently important total flow rate of an effluent gas produced by combustion of a fossil fuel, VF, can be determined by measuring or determining: the temperature, density ($\rho_{gas}$), and pressure of the effluent gas; concentrations of one or more of the constituent gases comprising the effluent gas; an average molecular weight of the constituent gases ($N_{gas}$); a molar fraction of the as-fired fuel required to generate one hundred moles of dry effluent gas (x); an as-fired mass flow rate of the fuel combusted (MF); and the molecular weight of the fuel combusted ($N_{AF}$).

Furthermore, the independently important input fuel mass flow rate, MF, can be determined generally (and specifically as set forth in more detail herein) by determining: system efficiency independent of fuel flow; total energy flow and power produced by combustion; and from these determinations determining the input fuel mass flow rate.

DRAWINGS

Figure 1B:
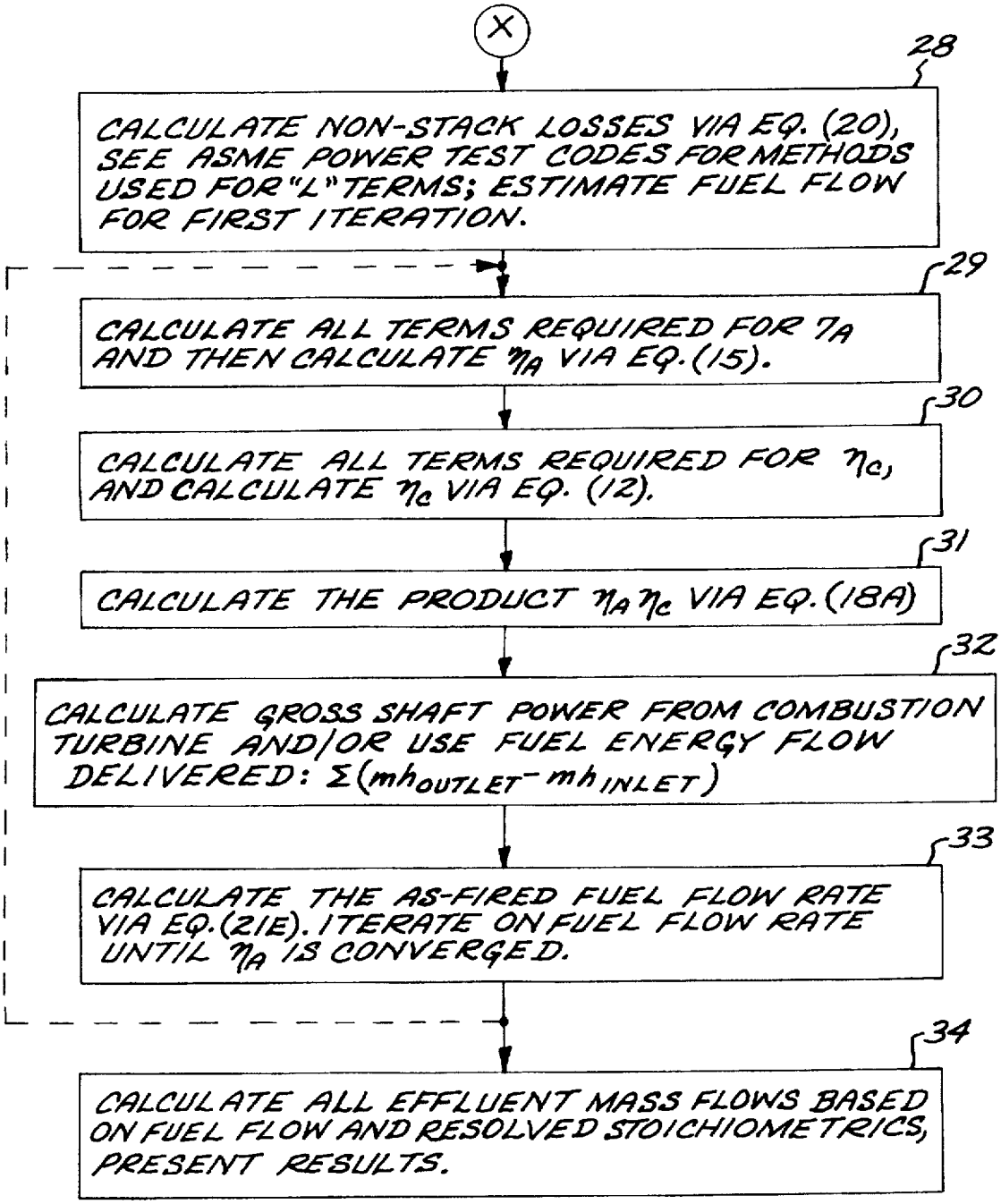
Figure 2:
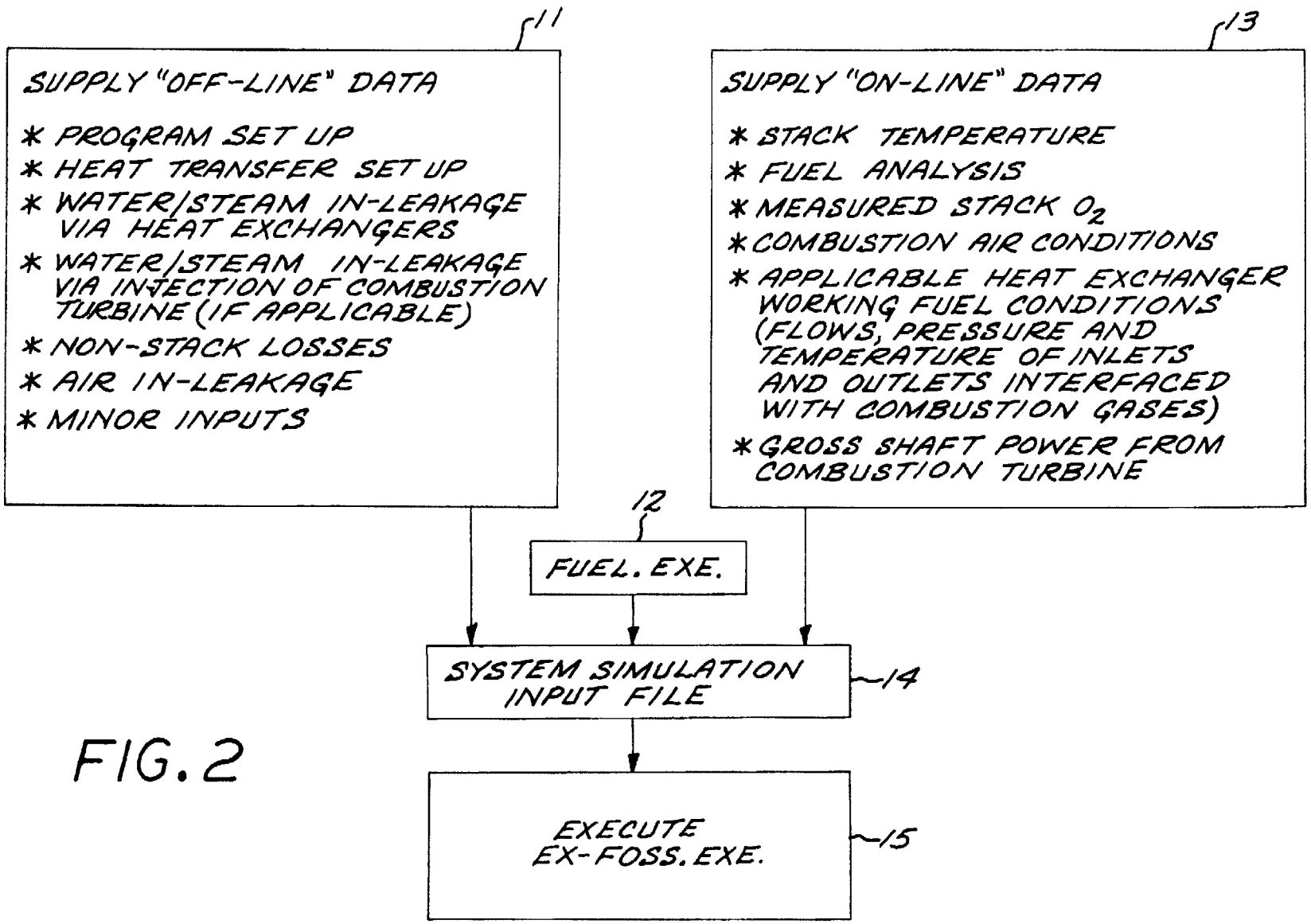
FIG. 2 is a block diagram illustrating information which can be supplied to the preferred embodiment of the disclosed method, prior to commencing the preferred method, and wherein completion of the preferred method is facilitated by use of an EX-FOSS™ computer program.
Figure 3A:
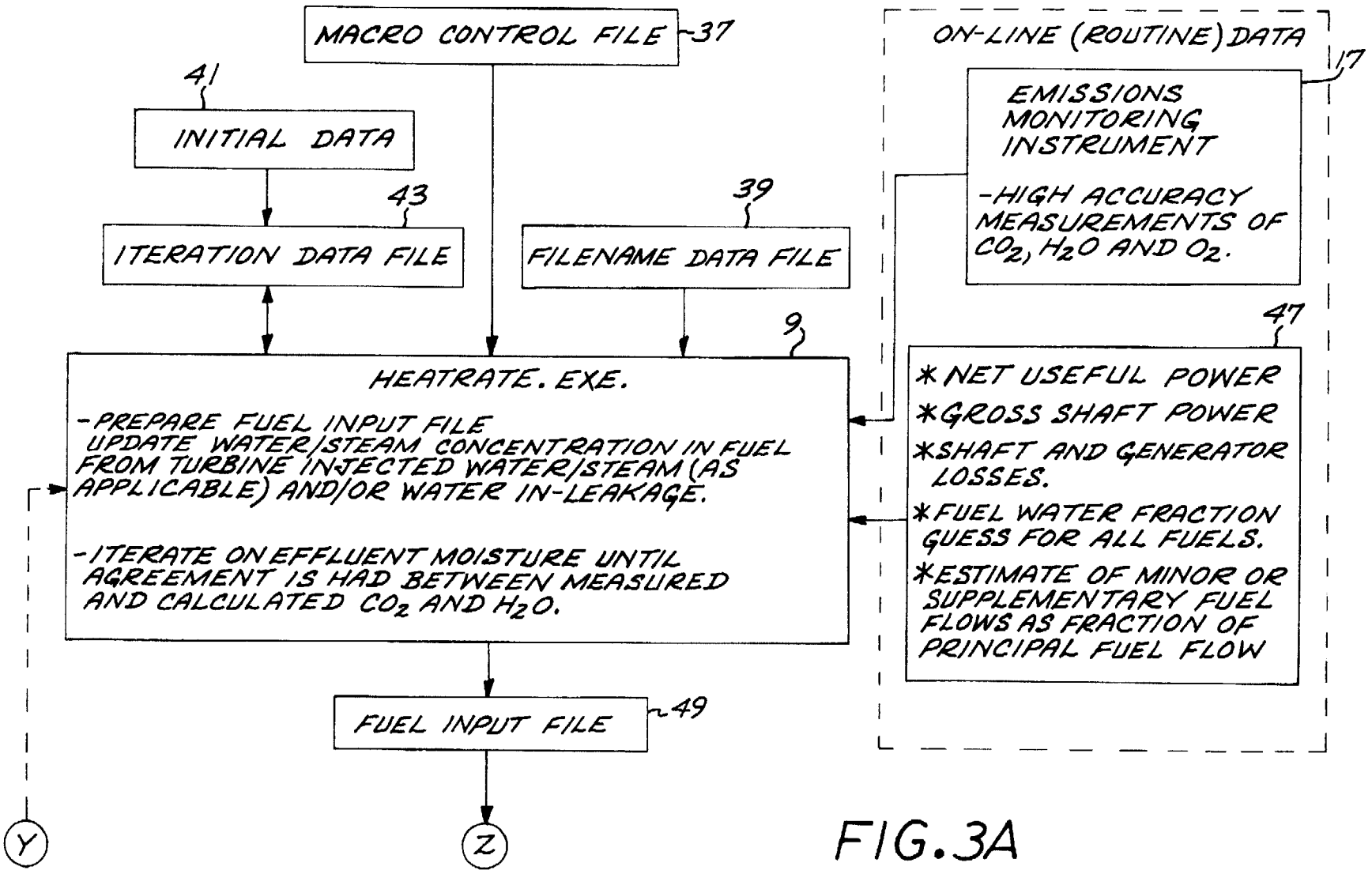
FIGS. 3A and 3B are block diagrams illustrating a preferred information flow in computer programs comprising the disclosed HEATRATE, FUEL and EX-FOSS™ computer programs, including the input information illustrated by FIG. 2.
Figure 3B:
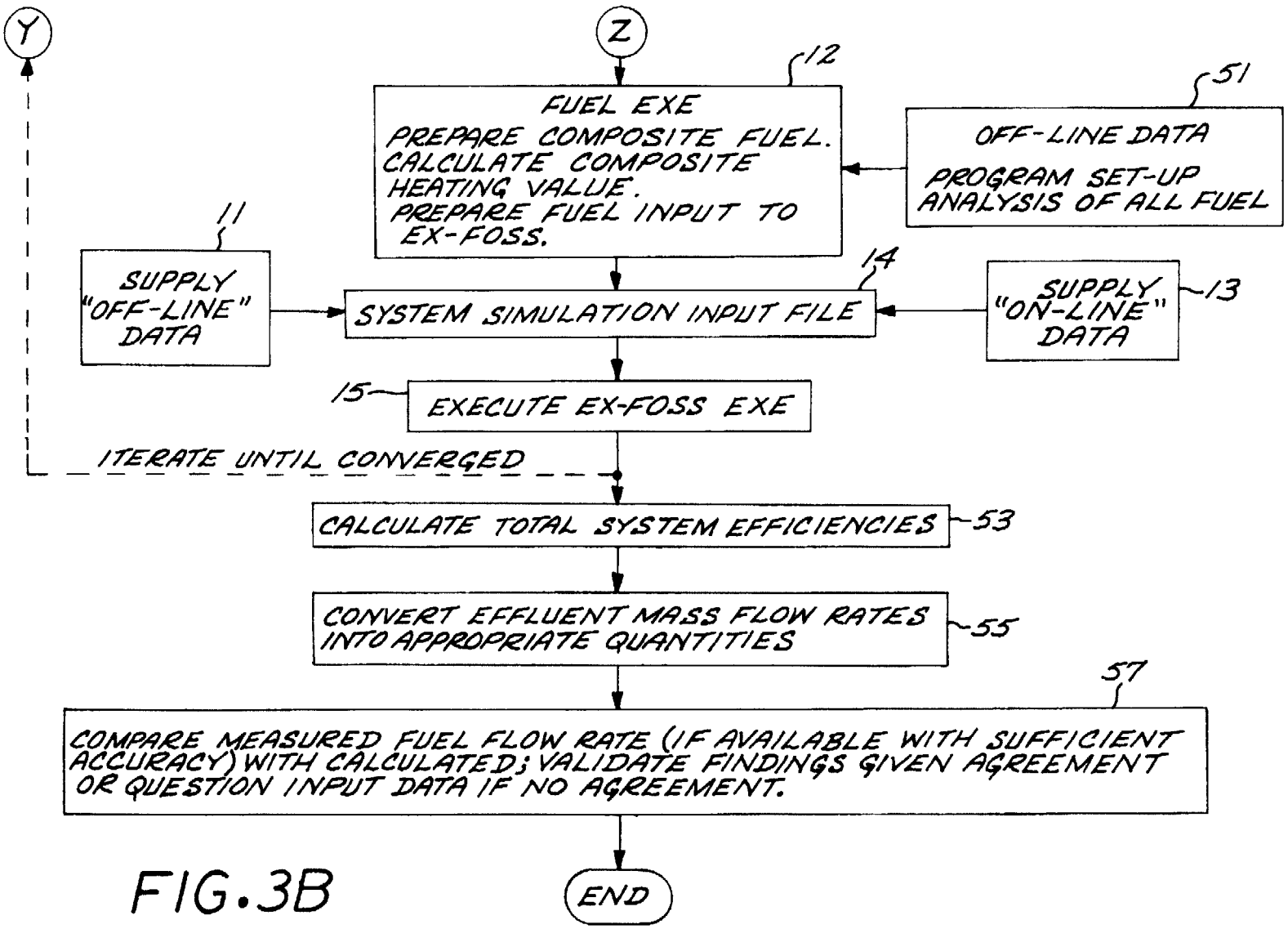

Three Figures are provided to illustrate significant aspects of the disclosed methods and systems. FIGS. 1A and 1B are block diagrams showing generally the steps of a preferred embodiment of the disclosed methods. FIG. 2 is a block diagram illustrating information which can be supplied to the preferred embodiment of the disclosed method, prior to commencing the preferred method, and wherein completion of the preferred method can be facilitated by use of the FUEL, HEATRATE and EX-FOSS™ computer program. FIG. 2 can therefore be viewed as illustrating input data required for the inter alia the EX-FOSS™ computer program to execute the computational steps and to solve the relevant equations set forth infra. FIGS. 3A and 3B are block diagrams illustrating a preferred information flow within the EX-FOSS™ computer program, including the input information illustrated by FIG. 2. Thus, FIGS. 3A and 3B illustrate an embodiment of a preferred method for determining, inter alia, fuel flow, total system efficiencies, and total effluent flow.

The HEATRATE, FUEL and EX-FOSS™computer programs were developed to assist accomplishment of the disclosed methods. These programs are commercially available from Exergetic Systems, Inc. of Point Richmond, Calif., and is designed to run on an Intel-based microprocessor personal computer. The EX-FOSS™ program incorporates a methodology which separates the definition of thermal efficiency into certain components which when taken separately permit one to calculationally exclude the problem of the complexities of the compressor of the combustion turbine system, the combustion process of burning fossil fuel and the turbine proper. Thus, thermal efficiency is separated into a combustion efficiency, $\eta_C$ term, and an absorption efficiency, $\eta_A$, term. Use of $\eta_C$ allows consideration of only input and output terms which can be measured with high accuracy, thus eliminating any need for resolution of a turbine's internal thermodynamic complexities. The use of $\eta_A$ allows for the consideration of only "non-stack" losses, losses which generally have minor impact on system efficiency, thus whose understanding does not require high resolution. Major losses in any fossil-fired power plant are associated with hot gas effluent (i.e., stack losses) and shaft inefficiencies. The problem of describing the complexities of convection and radiation heat transfer in complex geometries, as can occur in an HRSG system with a recovery boiler, is solved by calibrating internal correlations to actual test data, an internal feature of the EX-FOSS™ computer program.

As explained earlier, the EX-FOSS™ computer program requires the input of boundary conditions, principally the working fluid energy flows produced by burning fuel, the gaseous effluent, and the stack temperature. In addition, the process requires the accurate measurement of effluent $O_2$ concentration, and the input for comparison purposes of $CO_2$ and $H_2O$ concentrations, and common pollutant emission concentrations. These effluent or emission concentrations can be obtained from a suitable in-situ spectral radiometer, as for example the ESR/FF instrument disclosed by U.S. Pat. No. 5,327,356. Other suitable industrially available emission analyzers can also be used for this purpose. The principal results of the process are determination of fuel flows, emission flow rates (including all pollutants), and system thermal efficiencies.

FIG. 1 sets forth the steps of a preferred embodiment of the disclosed method. These steps of information flow are also use by inter alia the FUEL, HEATRATE, and EX-FOSS™ computer programs, and are explained below:

- Box 21–Acquire various items of off-line and on-line data, thereby initializing the EX-FOSS.EXE program;
- Box 22–Estimate a stack $CO_2$ concentration based upon complete combustion and the measured stack $O_2$ concentration;
- Box 23—Calculate a complete set of effluent molar concentrations, note that stack $O_2$ is fixed by input. This includes the calculated stack $H_2O$ as based on combustion $O_2$, hydrogen in the fuel as bound in hydrocarbon and hydrogen compounds and free $H_2$, moisture in the combustion air, in-leakage and/or injection of water, $H_2$ present in the stack and unburned hydrocarbon compounds present in the stack;
- Box 24—Calculate the error in $\eta_C$ based on consistent stoichiometrics and knowing the $N_2$ and $O_2$ ratio of combustion air;
- Box 25—If the calculational result is not converged on to a stable $\eta_C$ then iterate back through boxes 23 and 24, or if the calculation yields an acceptable error in $\eta_C$, continue the process;
- Box 26—Estimate a new $CO_2$ concentration if the error in $\eta_C$ is not acceptable;
- Box 28—Calculate Non-Stack Losses via Equation 20. See ASME Power Test Codes 4.1 and 4.4 for methods used for "L" terms, determine applicable turbine shaft losses, estimate the as-fired fuel flow rate for the first iteration;
- Box 29—Calculate all terms required for $\eta_A$, and then calculate $\eta_A$ via Equation 15;
- Box 30–Calculate all terms required for $\eta_C$, and calculate $\eta_C$ via Equation 12;
- Box 31–Calculate $\eta_{CT/HRSG}$ via Equation 18A, note that the formulation of $\eta_{CT/HRSG}$ is applicable to any fossil fuel fired system, as set forth infra;
- Box 32—Calculate the gross shaft power produced by the combustion turbine, and/or the total energy flow delivered to the working fluid from the hot combustion gases, as appropriate: $\Sigma(mh_{outlet}-mh_{inlet})$;
- Box 33–Calculate the as-fired total fuel flow rate, $m_{AF-CT}$, via Equation 21E, as supplied to the combustion turbine. Note that if the system to which the method is applied is a conventional boiler system, then this flow rate is the boiler's as fired fuel flow as explained earlier herein; iterate on fuel flow rate until $\eta_A$ is converged;

Box 34—Calculate all effluent mass flows using Equation 34 and their summation which is the total effluent mass flow including superheated water, as based on as-fired fuel flow, and resolved stoichiometrics; present results and end the method.

Input data used by the EX-FOSS™ computer program is illustrated by FIG. 2. Such input data consists of both "off-line data" (Box 11), which off-line data does not vary routinely, and "on-line data" (Box 13), which on-line data does vary with operational conditions. The "measured stack $O_2$" set forth by Box 13 is the same $O_2$ measurement indicated by Box 17 of FIG. 3A. Combined acquisition of off-line and on line information is indicated by Box 21. Thus, Box 21 represents both the Box 11 data and the Box 13 data. Additionally, the EX-FOSS™ computer program is supplied with fuel data using the FUEL computer program, described in Box 12, with additional illustration provided by FIG. 3. The calculational process is performed within the EX-FOSS.EXE (Box 15). Box 11 represents off-line data which includes: program set-up; heat transfer set up; tube leakage input; water and/or steam in-leakage via injection into the turbine; non-stack losses; air preheater leakage; and other minor inputs.

Box 13 represents on-line, or routine data which can include: stack temperature; fuel analysis; measured stack $O_2$; combustion air conditions; and gross shaft power produced from the turbine. Box 13 also represents on-line data descriptive of the net energy flow to the working fluid—that is output less inlet energy flows as described through knowledge of working fluid flows, pressures, and temperatures of the outlet and inlet streams. For example, using a conventional power plant employing boiler and reheater heat exchangers, working fluid energy flows can include: hot reheat energy flow less cold reheat; and turbine throttle energy flows less final feedwater. These input data, Boxes 11–13, are formed into an appropriate input computer file, Box 14, and thereafter supplied to the EX-FOSS™ computer program for analysis, Box 15.

FIG. 3 illustrates a generic process by which the computations are updated based upon actual power plant measurements of effluent $O_2$, $CO_2$ and $H_2O$ concentrations. It can be noted that FIG. 3B incorporates FIG. 2. Three principal computer programs are employed: HEATRATE.EXE (Box 9); FUEL.EXE (Box 12); and EX-FOSS (Box 15). The execution of these routines is governed by generic commands contained in computer macrocontrol files termed BAT files (Box 37).

The function of HEATRATE.EXE is to prepare input data for the FUEL.EXE program. Input to HEATRATE.EXE includes file-naming data (Box 39); initial data to track the iteration data (Box 41); and iteration data which is updated at each process iteration (Box 43). Results from the emissions monitoring instrument (Box 17) are also input to HEATRATE.EXE, which results are high accuracy measurements of $CO_2$ and $H_2O$ concentrations, and measurements of $O_2$ concentrations using common industrial techniques. Also input are Box 47, net power; gross shaft power generated (and/or net energy flow produced to the working fluid); known fuel flow data associated with minor stabilizing gas or oil fuel if applicable (natural gas is often used to stabilize the burning of coal), or supplementary fuel firing for a recovery boiler (see the Equation Term Definitions set forth infra, and the discussion following Equation 21E); and the initial guess of the fuel's water fraction. Output from HEATRATE.EXE comprises a computer file (Box 49) which is the fuel input file or the principal input data for FUEL.EXE (Box 12). Additional input to FUEL.EXE (Box 51) comprises the off-line data including the program set up, the specification of the dry chemical analysis of the fuel, the chemical analysis of any stabilizing fuel, and necessary computer control instructions.

FUEL.EXE computes, using either molar or weight fractions, the composite as-fired fuel composition, and calculates the heating value of the composite fuel. Its output consists of a modified EX-FOSS.EXE input data file which contains the composite fuel specification (Box 14 of FIG. 2 and Box 14 of FIG. 3B).

The EX-FOSS.EXE program: obtains certain input data as represented by Boxes 11–13; and resolves all thermodynamics associated with a combustion process. The results of the EX-FOSS.EXE calculations (Box 15), are iterated back through the HEATRATE.EXE program (Box 9), until converged. Then the fuel flow, and system efficiencies are calculated (Box 53). If a computed system efficiency is degraded from a norm, the operation of the system is adjusted to improve its thermal efficiency by means of the remedies suggested following Equation 21E, infra. If the system efficiency determined by application of the disclosed method is acceptable, then the program is simply put in a stand by mode until it is needed to be repeated to make a further check of the thermal efficiency of the system being monitored.

At this juncture, application of the disclosed method, as through use of the EX-FOSS™ and ancillary computer programs, has determined effluent mass flows (Box 34 of FIG. 1B) and this data can be converted to appropriate format, units and quantities useful for compliance with environmental reporting requirements (Box 55). These conversions are described by Equations 35A and 35B, and can preferably produce emission rates in pounds/million-$Btu_{fuel}$ and pounds/MWe, or similar conversions, in addition to total dry volumetric flow rate using Equation 36.

Finally, a comparison is made to the measured fuel flow rate, if available with sufficient accuracy, against the calculated (Box 57). If agreement between the measured and calculated fuel flow rates not obtained, then the accuracy of the input data is drawn into question. If agreement between the measured and calculated fuel flow rates is obtained, the entire method has been validated. Given such an agreement, if the computed emission data is found to be in violation of a relevant environmental regulation, then the operation of the system can be adjusted through changes in environmental control equipment, by reduction of the plant's fuel supply, thereby reducing all pollutant flows, and/or by improvement of the systems's thermal efficiency by means of the remedies set forth following Equation 21E, infra.

To provide additional detail regarding the iterative nature of the above-described preferred embodiment of the disclosed method, consider that the high accuracy measurement of the effluent $CO_2$ and $H_2O$ are compared in Box 9 with the calculated $CO_2$ and $H_2O$ concentrations. Any difference between the measured and the calculated $CO_2$ and $H_2O$ concentrations are then compared for acceptability. If the results are unacceptable then a further consideration is made whereby if the fuel is a gas or oil, without water in the fuel or in-leakage, the accuracy of the measured data is then questioned. Given accurate data, calculational closure must occur if the only water is chemically produced from combustion of hydrocarbon fuel. If it is a coal-fired plant, or a plant having water in-leakage (for example, a gas-fired turbine using steam injection for pollution control), and accurate input data is obtained, then iterations are performed on fuel water content through HEATRATE.EXE, FUEL.EXE, and EX-FOSS.EXE (Boxes 43, 9, 49, 11, 12, 13, and 15). Once the results of the comparison made in Box are acceptable, then the computations of Boxes 53, 55, and 57 are performed, as previously discussed, and the operation of the system is then adjusted.

The present invention has many advantages, including the following:

1. the thermal efficiency of a power plant, such as a combustion turbine system and a heat recovery-steam generator combustion turbine system can be improved, without the need to make any direct measurement of a fossil fuel flow rate into the combustor;

2. dry volumetric flow of total effluents at standard conditions can be determined;

3. emission rates for constituent gases of the total effluents, such as $NO_X$, $SO_2$, CO and $CO_2$ can be accurately determined in units of $lb_{pollutants}$/million-$Btu_{fuel}$. Additionally, emission mass flow rates for constituent gases, such as $NO_X$, $SO_2$, and $CO_2$, can be evaluated as $lb_{pollutants}$/hr;

4. an energy flow of an input fossil fuel to a CT/HRSG System to be determined without any direct measurement of the fuel flow rate, and the disclosed method can confirm that system mass and energy in-flows and out-flows are consistent.

5. determination of the energy flow of the input fossil fuel to a CT/HRSG System by analyzing the composition of the input fuel for its dry base chemical composition and by measuring the combustion effluents and then backcalculating the input fuel flow rate from the thermal efficiency equation can be carried out. Concurrently with this determination is the ability of the disclosed method to correct the fuel's heating value based upon accurate observed $H_2O$, $CO_2$, and $O_2$ emissions data.

6. The present invention permits determination of both the total effluent flow rate, the emission rates (pounds/million-$Btu_{fuel}$) of all pollutants, and flow rates (pounds/hr) of all effluents produced from a CT/HRSG system by determining the fuel flow rate indirectly and having knowledge of the fuel's chemistry. Thus, the present invention encompasses a method for determining the thermal efficiency of a CT/HRSG System without directly measuring the input fuel flow rate.

7. Additionally, the present invention permits an intrinsic self-checking procedure of the methods of this invention by comparing the calculated fuel flow rate and total system and/or thermal efficiency with the directly measured, if the direct measurement is obtained with known and high accuracy. If the directly measured fuel flow rate and total system and/or thermal efficiency is accurately known, and compares satisfactory with the calculated fuel flow rate and efficiency, then the methods of this invention assure that the following are determined with satisfactory accuracy: fuel flow rate, correction of the fuel's heating value, total effluent flow rate, the emission rates of all pollutants, flow rates of all effluents, and thermal efficiency.

Although the present invention has been described in considerable detail with regard to certain preferred embodiments thereof, other embodiments within the scope of the present invention are possible. For example, the disclosed methods for determining: (1) fuel flow, (2) thermal efficiency, (3) total emission flows, and (4) individual flow rates of constituent gases making up the total emission flow can all be applied to many diverse types of fossil-fuel, power producing systems, such as: (a) a conventional boiler system, (b) a combustion turbine system, and (c) a combined combustion turbine system and heat recovery-steam generator system.

Accordingly, the spirit and scope of the appended claims should not be limited to the descriptions of the preferred embodiments disclosed herein.

I claim:

1. A method for improving a thermal efficiency of a fossil fuel fired system, comprising the steps of:

(a) analyzing a sample of a fossil fuel supplied to a combustor of a fossil fuel fired system to determine the composition of the fossil fuel;

(b) measuring a temperature of a gas effluent from the combustor, wherein the effluent gas comprises a mixture of constituent gases;

(c) measuring a concentration of a gaseous constituent of the gas effluent from the combustor;

(d) determining a thermal efficiency of the system;

(e) comparing the thermal efficiency of the system to a reference thermal efficiency; and (f) adjusting an operation of the system to improve its thermal efficiency and/or its system efficiency.

2. The method of claim 1, wherein the fossil fuel fired system is a combustion turbine system.

3. The method of claim 2, wherein the combustion turbine system system efficiency is determined by a method comprising the steps of:

(a) determining a combustion efficiency;

(b) determining an absorption efficiency; and (c) combining the combustion efficiency and the absorption efficiency, to thereby determine a combustion turbine system system efficiency.

4. The method of claim 2, wherein the combustion turbine system thermal efficiency is determined independently of a fuel flow rate of a fossil fuel supplied to the combustor.

5. The method of claim 2, wherein the sample of a fossil fuel is analyzed for its dry base chemical composition.

6. The method of claim 2, wherein a constituent gas is carbon dioxide, and the temperature and concentration of carbon dioxide in the gas effluent from the combustor is measured.

7. The method of claim 6, wherein the concentration of the carbon dioxide gas effluent from the combustor is measured to an accuracy of at least about ±1% Δ molar.

8. The method of claim 7, wherein the concentration of the carbon dioxide gas effluent from the combustor is measured to an accuracy of at least about ±0.5% Δ molar.

9. The method of claim 2, wherein a constituent gas is superheated water, and the temperature and concentration of superheated water in the gas effluent from the combustor is measured.

10. The method of claim 9, wherein the concentration of the superheated water effluent from the combustor is measured to an accuracy of at least about ±1% Δ molar.

11. The method of claim 2, wherein a constituent gas is oxygen and the concentration of oxygen in the gas effluent from the combustor is measured.

12. The method of claim 11, wherein the concentration of the oxygen gas effluent from the combustor is measured with an accuracy at least comparable to zirconium oxide detection.

13. A method for improving a thermal efficiency of a combustion turbine system, comprising the steps of:

(a) analyzing a sample of a fossil fuel supplied to a combustor of a combustion turbine system to determine the dry base chemical composition of the fossil fuel;

(b) measuring at a gas exit boundary of the combustion turbine system in an exhaust from the combustion process;

(i) a temperature of a gas exiting the combustion turbine, (ii) a concentration of gaseous carbon dioxide to an accuracy of at least about ±0.5% Δ molar, (iii) a concentration of a superheated water effluent to an accuracy of at least ±1% Δ molar, and (iv) a concentration of a gaseous oxygen effluent with an accuracy at least comparable to zirconium oxide detection;

(c) determining, independently of a fuel flow rate of a fossil fuel into the combustor, a combustion efficiency;

(d) determining an absorption efficiency;

(e) combining the combustion efficiency and the absorption efficiency to determine a combustion turbine system system efficiency;

(f) comparing the combustion turbine system efficiency to a reference combustion turbine system efficiency; and (g) adjusting an operation of the combustion turbine system to improve its thermal efficiency and/or its system efficiency.

14. The method of claim 13, wherein the combustion turbine system comprises a heat recovery-steam generator system.

15. A method for improving a thermal efficiency of a combined heat recovery-steam generator and combustion turbine system, comprising the steps of:

(a) analyzing a sample of a fossil fuel supplied to a combustor of a combustion turbine system to determine the composition of the fossil fuel;

(b) measuring a temperature and concentration of a combustion gas effluent from the combustor;

(c) measuring a net energy deposition and power developed from the combustion gas;

(d) determining independently of a fuel flow rate of a fossil fuel into the combustor, a combustion efficiency based upon a stoichiometric balance of a combustion equation and an absorption efficiency based upon a measurement of a non-stack heat loss;

(e) combining the combustion efficiency and the absorption efficiency to determine a combined heat recovery-steam generator and combustion turbine system system efficiency;

(f) comparing the combined heat recovery-steam generator and combustion turbine system efficiency to a reference combined heat recovery-steam generator and combustion turbine system efficiency; and (g) adjusting an operation of the combined heat recovery-steam generator and combustion turbine system to improve a thermal efficiency and/or a system efficiency of the combined heat recovery-steam generator and combustion turbine system.

16. The method of claim 15, wherein the sample of a fossil fuel is analyzed for its dry base chemical composition.

17. The method of claim 15 including the steps of repetitiously adjusting an assumed water concentration in the fuel until consistency is obtained between the measured $CO_2$ and $H_2O$ effluents and computed $CO_2$ and $H_2O$ effluents determined by stoichiometrics based on the chemical composition of the fuel, thereby establishing the validity of the calculated combustion turbine thermal efficiency and/or total system efficiency.

18. The method of claim 15, wherein the measured carbon dioxide and water effluents are measured by using an emissions spectral radiometer instrument.

19. The method of claim 15 including determining whether degradations of operation are occurring in the recovery boiler or in the combustion turbine, and whether stack losses are increasing, by detecting decreases in combustion efficiency which is determined in an iterative manner.

20. The method of claim 15 including determining whether degradations of operation are occurring due to increased radiation and convection losses, heat content remaining in the heat exchanger water/steam leaks, heat exchanger loss of effectiveness, and increases in other non-stack losses by observing decreases in iterative absorption efficiency calculations.

21. A method for determining and improving a thermal efficiency of a fossil-fuel combustion turbine system comprising a combustion turbine in which a fossil fuel is supplied at a flow rate to produce shaft power, the combustion of the fuel producing an effluent combustion gas in an exhaust, the effluent combustion gas from the combustion turbine being capable of heating a working fluid, and a turbine cycle in which the working fluid does work, comprising the following steps:

analyzing the fuel for its dry base chemical composition, measuring in the exhaust combustion gas from the combustion process at the gas exit boundary of the power plant system the temperature, concentrations of $CO_2$ and $H_2O$ effluents to at least an accuracy of ±1% Δ molar, and concentrations of $O_2$ with an accuracy at least comparable to zirconium oxide detection, measuring a shaft power produced, determining, independently of the fuel mass flow rate, both a combustion efficiency as based on a stoichiometric balance of a combustion equation and an absorption efficiency based on determination of non-stack losses, combining combustion efficiency and absorption efficiency to obtain a combustion turbine system system efficiency, repetitiously adjusting assumed water concentration in the fuel until consistency is obtained between the measured $CO_2$ and $H_2O$ effluents and those determined by stoichiometries based on the chemical concentration of the fuel for establishing validity for a calculated fuel mass flow rate and boiler efficiency, determining whether degradations from predetermined parameters are occurring in the fuel-air mixing equipment, the differential system fuel flows, the heat content of the fuel, and whether stack losses are increasing by detecting decreases in iterative combustion efficiency calculations, determining whether degradations from predetermined parameters are occurring due to increased radiation and convection losses, heat content remaining in the coal rejects, heat exchanger water/steam leaks, heat exchanger loss of effectiveness, and increases in other non-stack losses by detecting decreases in iterative absorption efficiency calculations, and adjusting operation of the combustion turbine system to improve its thermal efficiency and/or its system efficiency.

22. A method for determining a fuel flow rate and pollutant flow rates of a fossil fuel fired system by monitoring the operation of the system and making calculations which are derived from data obtained from the analysis of the chemical composition of a dry component of the fuel, concentrations of common pollutants produced from combustion, and concentrations of $CO_2$ and superheated water produced from combustion of the fuel, the method comprising the steps of:

analyzing the fuel for its dry base chemical composition, measuring at a gas exit boundary of the system in the exhaust of the combustion process the temperature, concentrations of $CO_2$ and $H_2O$ effluents to an accuracy of at least ±1% Δ molar, and concentrations of $O_2$ with an accuracy at least comparable to zirconium oxide detection, measuring the net energy deposition to a working fluid being heated by the combustion process, calculating, independently of the fuel flow rate, a combustion efficiency based on the stoichiometric balance of a combustion equation and an absorption efficiency based on determination of non-stack losses, combining the combustion efficiency and the absorption efficiency to obtain a system efficiency, and determining the fuel flow rate from the system efficiency.

23. The method of claim 22, wherein the fossil fuel fired system is a combustion turbine system.

24. The method of claim 22, further comprising the steps of repetitiously changing the assumed value of water concentration in the fuel until consistency is obtained between the measured $CO_2$ and $H_2O$ effluents and computed $CO_2$ and $H_2O$ effluents determined by stoichiometries based on the chemical composition of the fuel, thereby establishing validity for the calculated fuel mass flow rate.

25. The method of claim 22, wherein the measured carbon dioxide and water effluents are measured by using an emissions spectral radiometer instrument.

26. The method of claim 22 wherein action is taken to adjust operation of the system to minimize pollutant concentrations effluent from the system by selecting an action from the group consisting of lowering the fuel firing rate, mixing fuels having different sulfur contents for $SO_2$ and $SO_3$ control, lowering the combustion flame temperature for $NO_X$ control, and mixing fuels having different nitrogen contents for $NO_X$ control.

27. The method for determining a fuel flow rate and pollutant flow rates of claim 22 including the steps of repetitiously changing an assumed value of water concentration in the fuel until consistency is obtained between the measured $CO_2$ and $H_2O$ effluents and the computed $CO_2$ and $H_2O$ effluents determined by stoichiometries based on the chemical composition of the fuel, thereby establishing validity for the calculated pollutant flow rates.

28. A method for determining fuel flow, total effluent flow rate, and individual pollutant flow rates, and improving thermal efficiency of a fossil-fired steam generator power plant system comprising a steam generator system in which a fossil fuel is supplied at a flow rate to be combusted to produce shaft power and/or to heat a working fluid, the combustion of the fuel producing effluents in an exhaust, and a turbine cycle in which the working fluid does work, the method comprising the following steps:

analyzing the fuel for its dry base chemical composition, measuring at a gas exit boundary of the power plant system, in the exhaust, the temperature, the concentrations of $CO_2$ and $H_2O$ effluents to a predetermined accuracy, and $O_2$ with an accuracy at least comparable to zirconium oxide detection, measuring the net energy deposition to the working fluid being heated by the combustion process, determining, independently of the fuel flow rate, a combustion efficiency based on a stoichiometric balance of a combustion equation and an absorption efficiency based on determination of non-stack losses, combining the combustion efficiency and the absorption efficiency to obtain a system efficiency, determining an auxiliary turbine efficiency, determining a shaft efficiency;

combining the absorption efficiency, the turbine cycle efficiency, and the shaft efficiency to obtain the total system efficiency, determining in response to obtaining the absorption efficiency and the system efficiency if either is degraded from predetermined parameters, and adjusting operation of the power plant system to improve its absorption efficiency and/or its total system efficiency.

29. The method according to claim 28, wherein the concentration of a superheated water effluent is measured to a predetermined accuracy of at least ±1% Δ molar.

30. The method of claim 28, further comprising the step of determining the fuel flow rate from the absorption efficiency.

31. The method of claim 28, further comprising the steps of:

(a) measuring the concentration of the common pollutants in the exhaust of the combustion process with an accuracy comparable to standard industrial practise; and (b) determining the pollutant flow rates from the fuel mass flow rate, knowledge of the concentrations of the common pollutants, and by determining the total effluent flow rate through stoichiometics.

32. The method according to claim 28, further comprising the steps of repetitiously adjusting an assumed water concentration in the fuel until consistency is obtained between the measured $CO_2$ and $H_2O$ effluents and the $CO_2$ and $H_2O$ effluents determined by stoichiometrics based on the chemical composition of the fuel, thereby establishing the validity of the calculated boiler efficiency and/or total system efficiency.

33. A method for determining a flow rate of an effluent gas produced by combustion of a fossil fuel, comprising the steps of:

(a) measuring a temperature of an effluent gas, wherein the effluent gas comprises a mixture of constituent gases;

(b) measuring a pressure of the effluent gas;

(c) determining a concentration of a constituent gas in the effluent gas;

(d) determining a density of the effluent gas;

(e) determining an average molecular weight of the constituent gases;

(f) determining a molecular weight of the fuel combusted;

(g) determining a molar fraction of the as-fired fuel required to generate a reference unity moles of the effluent gas; and (h) determining an as-fired mass flow rate of the fuel combusted, thereby determining effluent gas flow rate.

34. The method of claim 33, wherein the effluent gas is produced by combustion of a fossil fuel in a system selected from a conventional boiler system, a combustion turbine system, and a combined combustion turbine system and heat recovery-steam generator system.

35. A method for determining a flow rate of a gaseous constituent of an effluent gas produced by combustion of a fossil fuel, comprising the steps of:

(a) measuring a temperature of an effluent gas, wherein the effluent gas comprises a mixture of constituent gases;

(b) measuring a pressure of the effluent gas;

(c) determining a concentration of a constituent gas in the effluent gas;

(d) determining a density of the effluent gas;

(e) determining an average molecular weight of the constituent gases;

(f) determining a molecular weight of the fuel combusted;

(g) determining a molar fraction of the as-fired fuel required to generate a reference unity moles of the effluent gas; and (h) determining an as-fired mass flow rate of the fuel combusted, thereby determining a flow rate of the constituent gas.

36. A system for determining and improving a thermal efficiency of a combustion turbine system, comprising:

(a) apparatus for analyzing a sample of a fossil fuel supplied to a combustor of a combustion turbine system to determine the composition of the fossil fuel;

(b) apparatus for measuring a temperature of a gas effluent from the combustor, wherein the effluent gas is a mixture of constituent gases;

(c) apparatus for measuring a concentration of a constituent gas;

(d) apparatus for determining a combustion turbine system efficiency;

(e) apparatus for comparing the combustion system efficiency to a reference combustion system efficiency; and (f) apparatus for adjusting an operation of the combustion turbine system to improve a thermal efficiency and/or a system efficiency of the combustion turbine system.

37. The system of claim 36, wherein the apparatus for analyzing a sample of a fossil fuel is selected from the group consisting of a gas chromatograph and a mass spectrometer.

38. The system of claim 36, wherein the apparatus for measuring a temperature of a gas effluent from the combustor comprises a thermocouple.

39. The system of claim 36, wherein the apparatus for measuring a concentration of a constituent gas comprises an emissions spectral radiometer.

40. The system of claim 36, wherein the apparatus for determining a combustion turbine system efficiency, for comparing the combustion system efficiency to a reference combustion system efficiency, and for adjusting an operation of the combustion turbine system to improve a thermal efficiency of the combustion turbine system comprises a programmed computer.

* * * * *